US007500585B2

(12) United States Patent
Masuda

(10) Patent No.: US 7,500,585 B2
(45) Date of Patent: Mar. 10, 2009

(54) FLUID-STORING CONTAINER

(76) Inventor: Masatoshi Masuda, 2, 9-banchi, Takada-Cho, Saiin, Ukyo-ku, Kyoto-city, Kyoto 615-0031 (JP)

( * ) Notice: Subject to any disclaimer, the term of this patent is extended or adjusted under 35 U.S.C. 154(b) by 479 days.

(21) Appl. No.: 11/189,524

(22) Filed: Jul. 26, 2005

(65) Prior Publication Data

US 2006/0021994 A1 Feb. 2, 2006

(30) Foreign Application Priority Data

Jul. 30, 2004 (JP) ..... 2004-223681

(51) Int. Cl.
*B65D 35/38* (2006.01)

(52) U.S. Cl. ..... 222/494; 137/614.2; 137/854

(58) Field of Classification Search ..... 222/92, 222/209, 212–213, 386.5, 491–492, 494–495, 222/497, 509; 137/92, 614.2, 614.18, 854
See application file for complete search history.

(56) References Cited

U.S. PATENT DOCUMENTS 530,442 A * 12/1894 Munger ..... 137/517
1,869,808 A * 8/1932 Hancock ..... 222/496
2,106,775 A * 2/1938 Trask ..... 417/550
3,179,122 A * 4/1965 Wasdell ..... 137/493
3,246,807 A * 4/1966 Micallef ..... 222/207
3,456,650 A * 7/1969 Schwartzman ..... 604/298
3,506,162 A * 4/1970 Schwartzman ..... 222/207
3,648,728 A * 3/1972 Perry et al. ..... 137/854
3,754,690 A * 8/1973 Marchant ..... 222/494
4,054,152 A * 10/1977 Ito et al. ..... 137/512
4,609,006 A * 9/1986 Parkison et al. ..... 137/119.04
4,712,574 A * 12/1987 Perrott ..... 137/217
4,762,149 A * 8/1988 Pickl, Jr. ..... 137/843
5,325,885 A * 7/1994 Ivan et al. ..... 137/217
5,931,352 A * 8/1999 Dirr ..... 222/212
6,223,956 B1 * 5/2001 Albers ..... 222/494
6,581,808 B2 * 6/2003 De Laforcade ..... 222/483
6,644,510 B2 * 11/2003 Kawolics et al. ..... 222/105
6,688,495 B2 * 2/2004 Masuda ..... 222/92
6,854,623 B2 * 2/2005 Masuda ..... 222/212

(Continued)

FOREIGN PATENT DOCUMENTS

EP 1 291 288 A2 3/2003

(Continued)

*Primary Examiner*—Kevin P Shaver
*Assistant Examiner*—Andrew P Bainbridge
(74) *Attorney, Agent, or Firm*—Law Office of Katsuhiro Arai

(57) ABSTRACT

A valve mechanism (3) includes a valve seat member (31) having a guiding portion (319); a valve member (32) having a valve body (321), a guiding shaft (322), and a supporting shaft (323); and a sub-valve member (33) having a sub-valve body (331) and a connecting portion (332). The valve body (321) and the sub-valve body (331) ascend together by pressing the fluid-storing portion (11); and the valve body (321) travels to an open position and the sub-valve body (331) travels to a detached position. In this state, when a pressure applied to the fluid-storing portion (11) is removed, the valve body (321) and the sub-valve body (331) descend together; and after the sub-valve body (331) travels to a contact position, the valve body (321) travels to a closed position.

19 Claims, 21 Drawing Sheets

U.S. PATENT DOCUMENTS

| | | | | |
|---|---|---|---|---|
| 6,957,799 | B2 * | 10/2005 | Heilmann et al. | 251/82 |
| 6,968,976 | B2 * | 11/2005 | Masuda | 222/92 |
| 7,059,499 | B2 * | 6/2006 | Masuda | 222/321.9 |
| 7,059,501 | B2 * | 6/2006 | Masuda | 222/494 |
| 7,082,967 | B2 * | 8/2006 | Sarajian et al. | 137/854 |
| 7,114,635 | B2 * | 10/2006 | Yamada | 222/83 |
| 7,249,694 | B2 * | 7/2007 | Masuda | 222/212 |
| 2003/0047570 | A1 | 3/2003 | Masuda | |
| 2003/0047572 | A1 | 3/2003 | Masuda | |
| 2003/0230596 | A1 | 12/2003 | Masuda | |
| 2004/0007601 | A1 | 1/2004 | Masuda | |
| 2004/0050872 | A1 | 3/2004 | Masuda | |

FOREIGN PATENT DOCUMENTS

| | | |
|---|---|---|
| EP | 1 391 392 A2 | 2/2004 |
| JP | 2004-059046 | 2/2004 |

* cited by examiner

FLUID-STORING CONTAINER

BACKGROUND OF THE INVENTION

1. Field of the Invention

The present invention generally relates to a fluid-storing container comprising a container main body which comprises a fluid-storing portion composed of a material having elastic resilience for storing a fluid therein, a mouth portion formed at an end of the fluid-storing portion for discharging the fluid, and a valve mechanism which can be attached to the mouth portion.

2. Description of the Related Art

As this type of fluid-storing container, a fluid-storing container described in Japanese Patent Laid-open No. 2004-059046 is known. The fluid-storing container is shown in FIG. 19, wherein a valve mechanism 3 which applies to a fluid-storing container comprises (i) a supporting portion 32 having a nearly tubular shape in the center of which an opening portion 31 constituting a valve seat is formed, (ii) a first connecting portion 34 installed upright on the side of a container main body 1 for an area in the supporting portion 32 in which the opening portion 31 is formed, (iii) a second connecting portion 35 having a nearly T-shaped section to be connected to the first connecting portion 34, and (iv) a connecting portion 36 giving momentum to a valve portion 33 toward the opening portion 31 constituting the valve seat, by connecting the supporting portion 32 and the second connecting portion 35 with elastic force. Consequently, according to the fluid-storing container described in Japanese Patent Laid-open No. 2004-059046, it becomes possible to prevent a backward air flow even though its configuration is simple.

However, the valve mechanism which applies to the fluid-storing container described in Japanese Patent Laid-open No. 2004-059046 has no structure to prevent the valve portion 33 from inadequately tilting. In order to prevent the valve portion 33 from inadequately tilting, it is required that the supporting portion 32 and the valve portion 33 are connected by a large number of connecting portions 36 evenly disposed. In this case, increase in manufacturing costs of the valve mechanism may be inevitable.

SUMMARY OF THE INVENTION

The present invention was accomplished to solve at least one or more of the above-mentioned problems. In an aspect, an object of the present invention is to provide a flexible fluid-storing container comprising a valve mechanism which can prevent a valve body from inadequately tilting while having a simple configuration. Another object of an embodiment of the present invention is to provide a fluid-storing container having a simple configuration and capable of preventing fluid leakage.

The present invention can be practiced in various ways including, but not limited to, embodiments described below, wherein numerals used in the drawings are used solely for the purpose of ease in understanding of the embodiments which should not be limited to the numerals. Further, in the present specification, different terms or names may be assigned to the same element, and in that case, one of the different terms or names may functionally or structurally overlap or include the other or be used interchangeably with the other.

In an embodiment, the present invention provides a fluid-storing container comprising: (A) a container main body (e.g., 1) comprising a shape-restorable fluid-storing portion (e.g., 11) (i.e., the shape is elastically restorable when no external force is exerted thereon, and the portion may be composed of a material having elastic resilience) for storing a fluid therein and a mouth portion (e.g., 12) formed at an end of the fluid-storing portion for discharging the fluid; and (B) a valve mechanism (e.g., 3, 4) attached to the mouth portion and comprising: (a) a valve seat member (e.g., 31, 41) comprising: (i) a valve seat (e.g., 317, 417) with an opening (e.g., 318, 418) through which the fluid is to pass, and (ii) a guiding portion (e.g., 319, 419) disposed under the valve seat coaxially with the opening, and (b) a valve member (e.g., 32, 42) connected to no biasing member and comprising: (i) a valve body (e.g., 321, 421) having a shape corresponding to that of the valve seat for opening and closing the opening of the valve seat depending on a pressure inside the fluid-storing portion, and (ii) a guiding shaft (e.g., 322, 422) integrated under the valve body coaxially with the valve body and slidably coupled with the guiding portion of the valve seat member.

The above embodiment further includes, but is not limited to, the following embodiments:

The guiding shaft may have a lower end engaging portion (e.g., 322*b*, 422*b*) which engages with a lower end (e.g., 312*b*, 412*b*) of the guiding portion to restrict upward movement of the guiding shaft.

The valve mechanism may further comprise a sub-valve body (e.g., 331) disposed above and coupled with the valve body (e.g., 321) coaxially with the valve body, wherein the valve seat member further comprises an inner wall (e.g., 313) extending from the valve seat upward, with which a periphery of the sub-valve body is in non-contact and contact for respectively opening and closing a clearance (e.g., 340) therebetween depending on a pressure inside the fluid-storing portion.

The valve member may further comprise a supporting shaft (e.g., 323) integrated above the valve body (e.g., 321) coaxially with the valve body, said sub-valve body being provided with a connecting portion (e.g., 332) which is slidably coupled with the supporting shaft. The supporting shaft may have an upper end engaging portion (e.g., 323*a*) which engages with a lower end (e.g., 332*b*) of the connecting portion to restrict upward movement of the connecting portion. The sub-valve body may have a diameter which is greater than that of the valve body. A distance (e.g., W) which the sub-valve body slides downward against the inner wall may be greater than a distance (e.g., V2) which the guiding shaft moves downward while the sub-valve body is in contact with the inner wall.

The valve seat (e.g., 317, 417) may have an annular convex portion (e.g., 314, 414) which is in contact with the valve body for closing the opening of the valve seat member. The valve seat (e.g., 317, 417) may be tapered downward.

The guiding portion may be comprised of multiple ribs (e.g., 312, 412) each extending inward from a circumference to a center (e.g., 341, 441) where the guiding shaft is supported. A gap (e.g., 311, 411) may be formed between the ribs, which is communicated with the opening and through which the fluid is to pass.

The fluid-storing container may further comprise a nozzle (e.g., 50) attached to the mouth portion of the container main body.

In another embodiment, the present invention provides a fluid-storing container comprising: (A) a container main body (e.g., 1) comprising: (i) a fluid-storing portion (e.g., 11) having elastic resilience for storing a fluid therein, and (ii) a mouth portion (e.g., 12) formed at an end of the fluid-storing portion for discharging the fluid; and (B) a valve mechanism (e.g., 3, 4) attached to the mouth portion, wherein the valve mechanism opens the mouth portion when a pressure inside the fluid-storing portion rises above a pressure of the exterior, and the valve mechanism closes the mouth portion when a pressure inside the fluid-storing portion drops below a pressure of the exterior, said valve mechanism comprising: (a) a valve seat member (e.g., 31, 41) comprising: (i) an opening portion (e.g., 317, 417) formed at its bottom and (ii) a guiding portion (e.g., 319, 419); and (b) a valve member (e.g., 32, 42) comprising: (i) a valve body (e.g., 321, 421) having a shape corresponding to that of the opening portion, which can travel between a closed position in which the valve body closes the opening portion of the valve seat member and an open position in which the valve body opens the opening portion; and (ii) a guiding shaft (e.g., 322, 422) installed upright and slidably connected to the guiding portion of the valve seat member.

The above embodiment further includes, but is not limited to, the following embodiments:

A lower upper-end locking portion (e.g., 312*a*, 412*a*) may be formed at an upper end portion of the guiding portion of the valve seat member, and a lower lower-end locking portion (e.g., 312*b*, 412*b*) may be formed at its lower end portion. In the guiding shaft of the valve member, a lower upper-end engaging portion (e.g., 322*a*, 422*a*) engaging with the lower upper-end locking portion may be formed, and a lower lower-end engaging portion (e.g., 322*b*, 422*b*) engaging with the lower-end locking portion is formed. The valve seat member and the valve member may be connected to each other mutually slidably between a lower upper-end engaging position in which the lower upper-end locking portion and the lower upper-end engaging portion are engaged, and a lower lower-end engaging position in which the lower lower-end locking portion and the lower lower-end engaging portion are engaged.

The valve member of the valve mechanism may further comprise a supporting shaft (e.g., 323) disposed upright in a direction opposite to the guiding shaft from the valve body. A nearly tubular inner wall (e.g., 313) may be formed at a top of the valve seat member of the valve mechanism. The valve mechanism may further comprise a sub-valve member (e.g., 33) comprising (i) a sub-valve body (e.g., 331) which can travel between a contact position in which the sub-valve body comes in contact with the inner wall of the valve seat member and a detached position in which the sub-valve body separates from the inner wall, and (ii) a connecting portion (e.g., 332) connected to the supporting shaft in said valve member. In the above, when a pressure inside fluid-storing portion rises above a pressure of the exterior, with the valve body and the sub-valve body ascending together, the aid valve body travels to the open position, and the aid sub-valve body travels to the detached position, and when a pressure inside fluid-storing portion drops below a pressure of the exterior, with the valve body and the sub-valve body descending together and after the sub-valve body travels to the contact position, the valve body travels to the closed position.

An upper upper-end locking portion (e.g., 323*a*) may be formed at an upper-end portion of the supporting shaft, and an upper lower-end locking portion (e.g., 323*b*) may be formed at its lower end. In the connecting portion in the sub-valve member, an upper upper-end engaging portion (e.g., 332*a*) engaging with the upper upper-end locking portion may be s formed, and an upper lower-end engaging portion (e.g., 332*b*) engaging with the upper lower-end locking portion may be formed. The valve member and the sub-valve member may be re connected to each other mutually slidably between an upper upper-end engaging position in which the upper upper-end locking portion and the upper upper-end engaging portion are engaged, and an upper lower-end engaging position in which the upper lower-end locking portion and the upper lower-end engaging portion are engaged.

A contact-travel distance (e.g., W) which the sub-valve body travels while being in contact with the inner wall of the valve seat member is longer than a sliding distance (e.g., V1) between the valve member and the sub-valve member.

In all of the aforesaid embodiments, any element used in an embodiment can interchangeably or additionally be used in another embodiment unless such a replacement is not feasible or causes adverse effect. Further, the present invention can equally be applied to apparatuses and methods.

For purposes of summarizing the invention and the advantages achieved over the related art, certain objects and advantages of the invention have been described above. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

Further aspects, features and advantages of this invention will become apparent from the detailed description of the preferred embodiments which follow.

BRIEF DESCRIPTION OF THE DRAWINGS

These and other features of this invention will now be described with reference to the drawings of preferred embodiments which are intended to illustrate and not to limit the invention. The drawings are oversimplified for illustrative purposes.

FIG. 5(*b*) is an enlarged view showing a state where the valve mechanism begins being closed in solid lines, and a state where the valve mechanism is completely closed in broken lines. FIG. 5(*c*) is a longitudinal sectional view showing a related portion of the valve mechanism 3 when the valve mechanism is being closed in a way different from FIG. 5(*a*) according to the first embodiment of the present invention.

FIG. 7(*a*) to 7(*d*) are a top view, side view, side cross-sectional view, and a bottom view, respectively.

FIG. 8(*a*) to 8(*c*) are a top view, side view, and side cross-sectional view, respectively.

FIG. 9(*a*) to 9(*c*) are a top view, side view, and side cross-sectional view, respectively.

FIGS. 15(*a*) to 15(*d*) are a top view, side view, side cross-sectional view, and bottom view, respectively.

FIG. 16(*a*) to 16(*c*) are a top view, side view, and side cross-sectional view, respectively.

Explanation of Symbols Used: 1: Container main body; 3: Valve mechanism; 4: Valve mechanism; 11: Fluid-storing portion; 12: Opening portion; 14: Male screw portion; 31: Valve seat member; 32: Valve member; 33: Sub-valve member; 41: Valve seat member; 42: Valve member; 50: Nozzle; 310: Convex portion; 311: Opening portion; 312: Rib; 312*a*: Lower upper-edge locking portion; 312*b*: Lower lower-edge locking portion; 313: Wall surface; 321: Valve body; 322: Guiding shaft; 322*a*: Lower upper-edge engaging portion; 322*b*: Lower lower-edge engaging portion; 323: Supporting shaft; 323*a*: Upper upper-edge locking portion; 323*b*: Upper lower-edge locking portion; 331: Sub-valve body; 332: Connecting portion; 332*a*: Upper upper-edge engaging portion; 332*b*: Upper lower-edge engaging portion; 410: Convex portion; 411: Opening portion; 412: Rib; 412*a*: Lower upper-edge locking portion; 412*b*: Lower lower-edge locking portion; 414: Convex surface; 421: Valve body; 422: Guiding shaft; 422*a*: Lower upper-edge engaging portion; 422*b*: Lower lower-edge engaging portion;

DETAILED DESCRIPTION OF THE PREFERRED EMBODIMENT

The present invention will be explained with respect to specific embodiments. However, the specific embodiments are not intended to limit the present invention.

Figure 1:
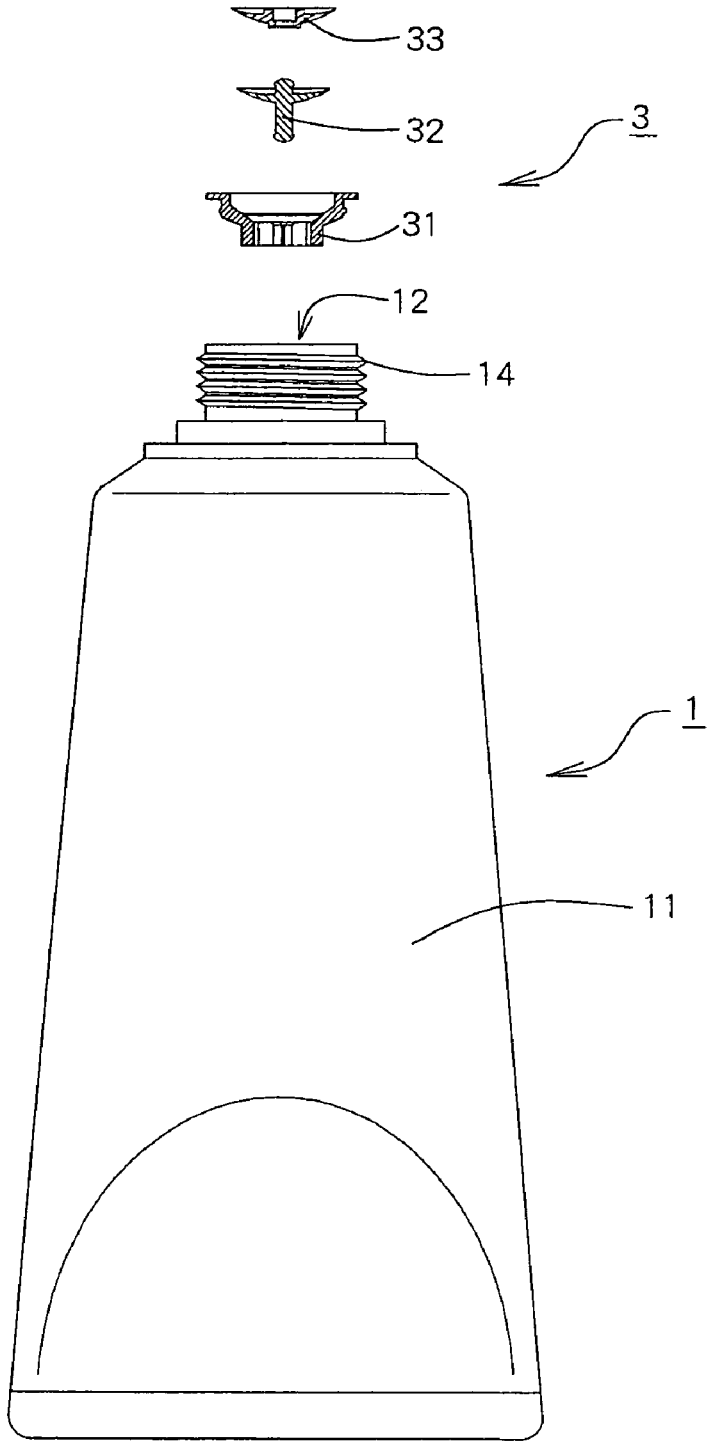
FIG. 1 is a longitudinal partially sectional view which shows a fluid-storing container according to a first embodiment of the present invention by taking it apart to pieces.

FIG. 1 is a longitudinal partially sectional view which shows a fluid-storing container according to a first embodiment of the present invention by taking it apart to pieces.

This fluid-storing container may be used as a container for beauty products for storing gels such as hair gels and cleansing gels, creams such as nourishing creams and cold creams or liquids such as skin lotions used in the cosmetic field. Additionally, this fluid-storing container also can be used as a container for general medicines, solvents or foods, etc. In this specification, high-viscosity liquids, semifluids, gels that sol solidifies to a jelly, and creams and regular liquids are all referred to as fluids.

This fluid-storing container comprises a container main body and a valve mechanism 3.

A container main body 1 comprises a fluid-storing portion 11 for storing a fluid inside it, an opening portion 12 for discharging the fluid and being formed at an end of the fluid-storing portion, a concave portion 13 formed on a inner peripheral surface of the opening portion 12 (See FIG. 2), and a male screw portion 14 formed on an outer side of the opening portion 12. Made by laminating a single synthetic resin or a synthetic resin and aluminum, this container main body 1 has elastic resilience that tries to restore its original shape when a pressure applied to it is removed. Additionally, with the male screw portion 14 in the container main body 1 being screwed together with a lid member not shown in which a female screw portion is formed inside, the opening portion 12 of the container main body 1 is closed.

In this fluid-storing container, when a pressure of the interior of the fluid-storing portion rises above a pressure of the exterior by pressing the fluid-storing portion 11, a valve mechanism 3 described in detail later opens the opening portion 12; when a pressure of the interior of the fluid-storing portion 11 drops below a pressure of the exterior with a pressure applied to the fluid-storing portion 11 removed, the valve mechanism 3 closes the opening portion 12.

FIGS. 2-6 are longitudinal sectional views showing the valve mechanism 3 in the fluid-storing container according to the first embodiment of the present invention.

Figure 2:
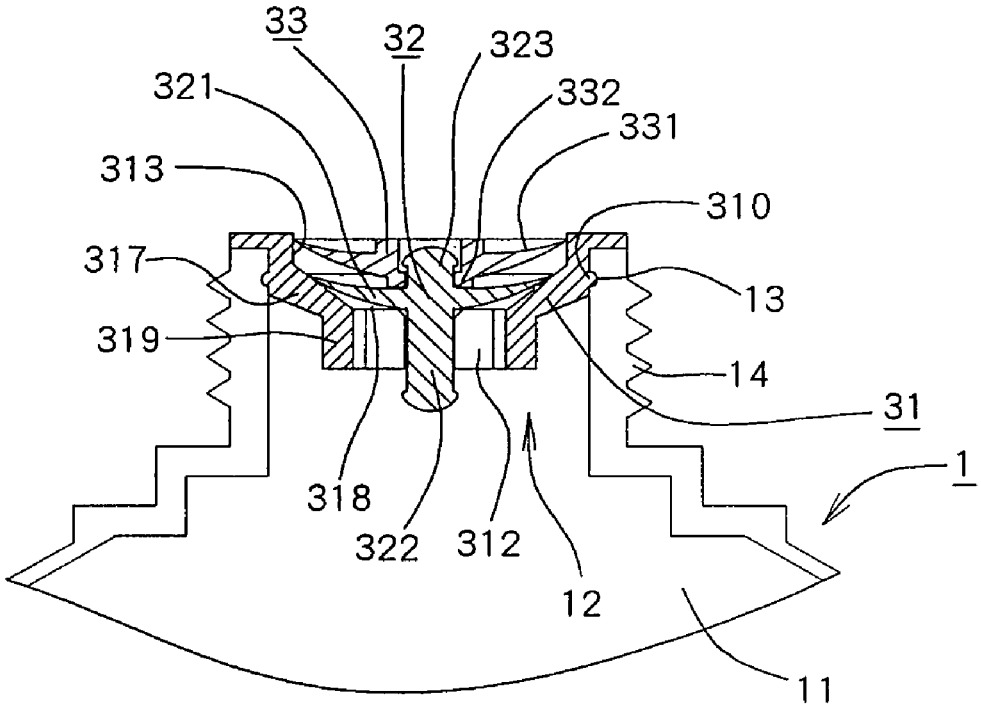
FIG. 2 is a longitudinal sectional view showing a related portion of a valve mechanism 3 according to the first embodiment of the present invention.
Figure 3:
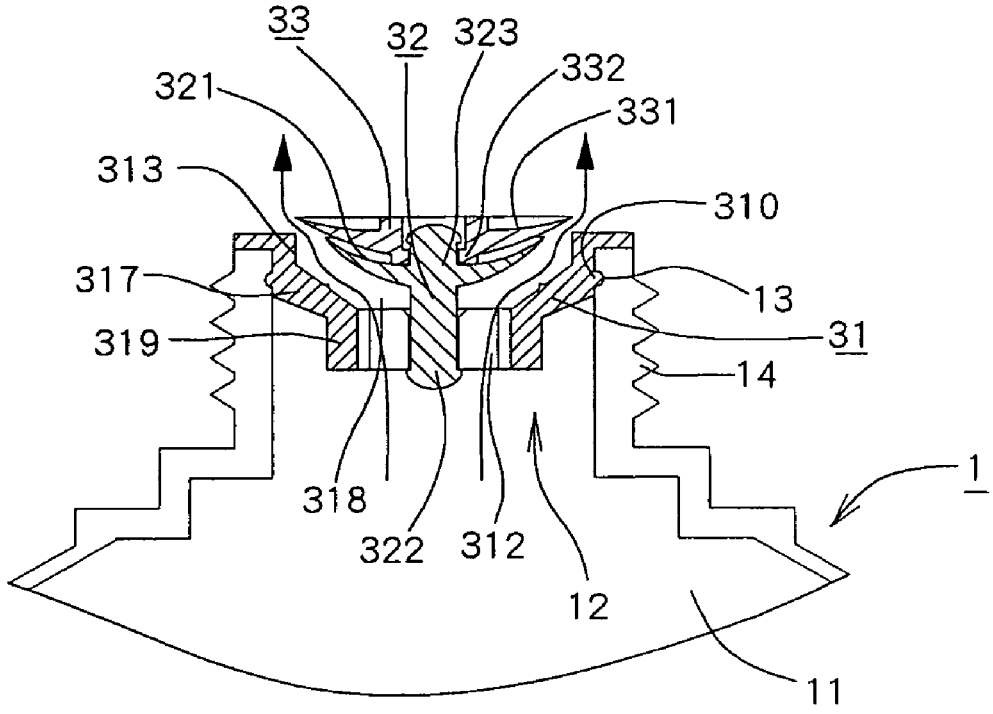
FIG. 3 is a longitudinal sectional view showing a related portion of the valve mechanism 3 when the inside pressure increases according to the first embodiment of the present invention.
Figure 4:
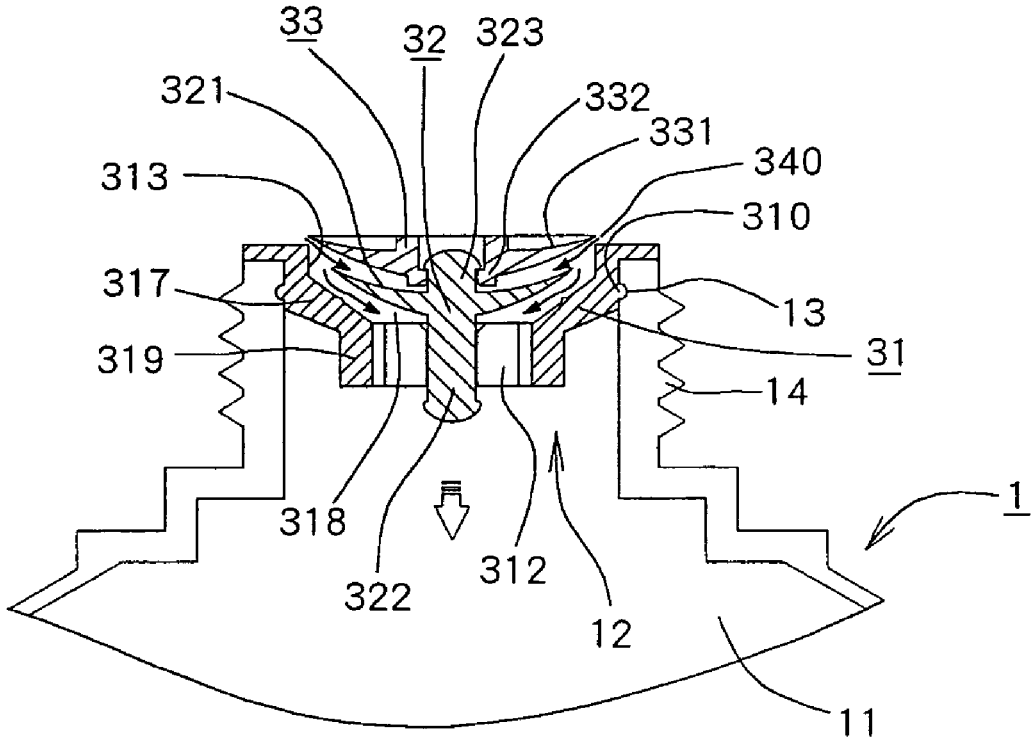
FIG. 4 is a longitudinal sectional view showing a related portion of the valve mechanism 3 when the inside pressure decreases according to the first embodiment of the present invention.
Figure 5A:
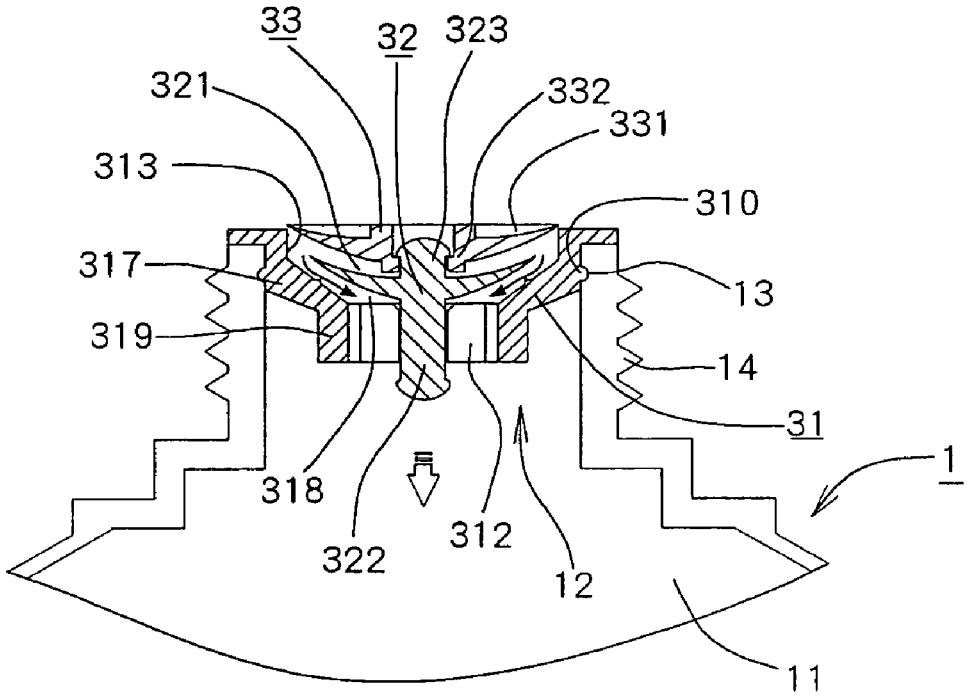
FIG. 5(*a*) is a longitudinal sectional view showing a related portion of the valve mechanism 3 when the valve mechanism is being closed according to the first embodiment of the present invention.
Figure 5B:
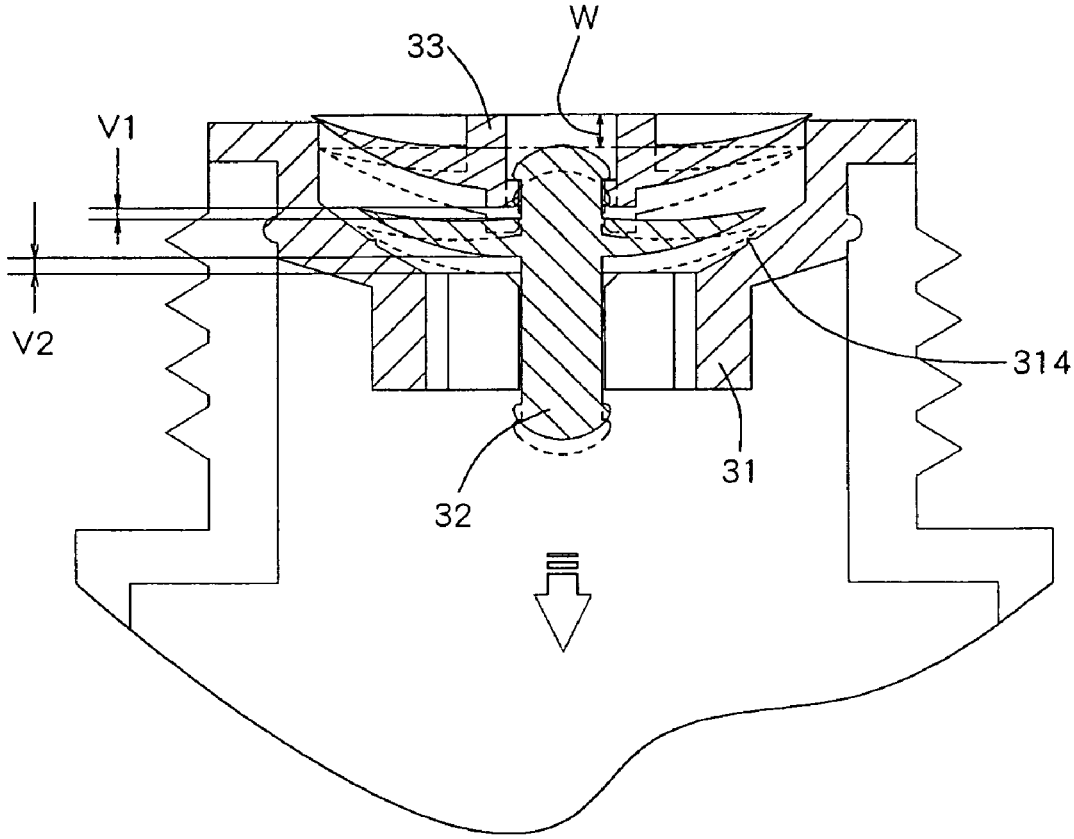
Figure 5C:
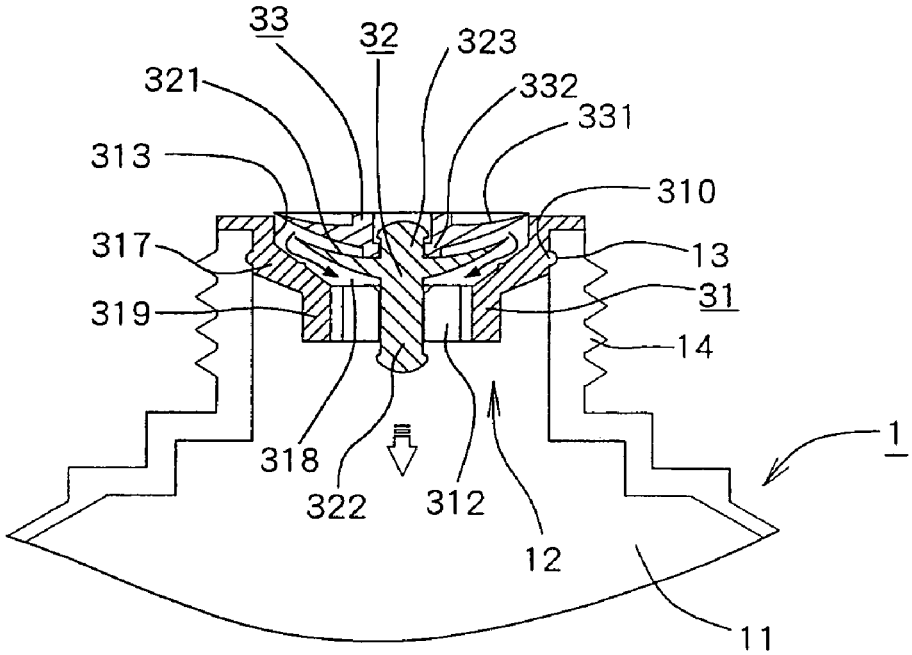
Figure 6:
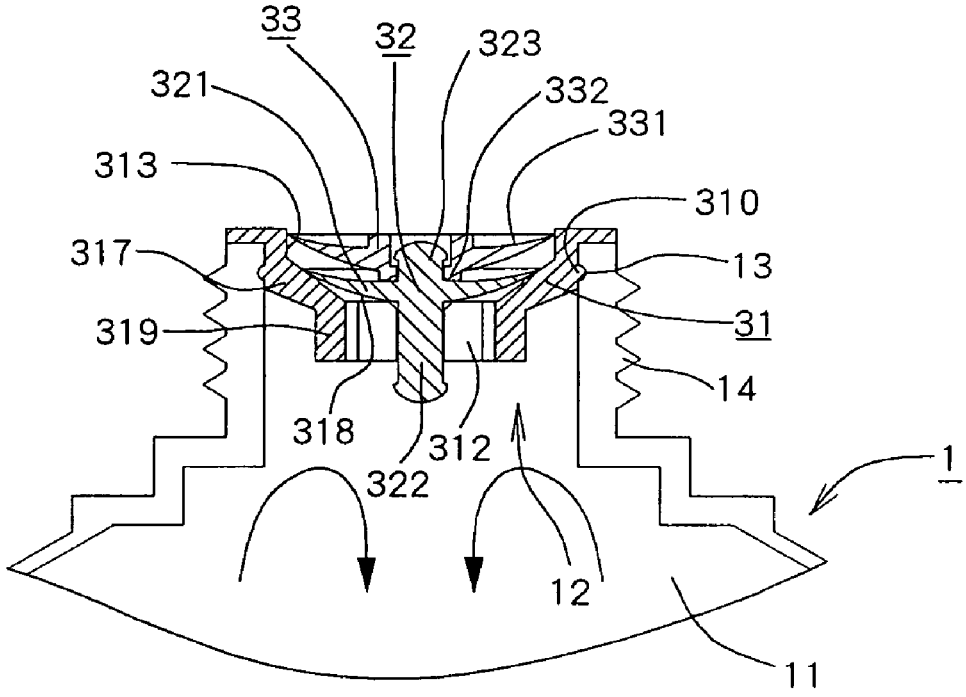
FIG. 6 is a longitudinal sectional view showing a valve mechanism 3 when the valve mechanism is completely closed according to the first embodiment of the present invention.

Additionally, of these figures, FIG. 2 shows a state in which the fluid-storing portion 11 is left without being pressed; FIG. 3 shows a state in which the valve mechanism 3' opens the opening portion 12 with the fluid-storing portion 11 being pressed; FIG. 4 shows a state in which a fluid remaining in the vicinity of the opening portion 12 is being sucked down into the fluid-storing portion 11 with a pressure applied to the fluid-storing portion 11 being removed; FIG. 5(*a*) shows a state in which a fluid remaining inside the valve mechanism 3 is being sucked down into the fluid-storing portion 11; FIG. 5(*c*) shows another state in which a fluid remaining inside the valve mechanism 3 is being sucked down into the fluid-storing portion 11; FIG. 6 shows a state in which the valve mechanism 3 completely closes the opening portion 12.

As shown in these FIGS. 2 to 6, the valve mechanism 3 comprises (i) a valve seat member 31 comprising a valve seat 317 (having an opening 318) and a guiding portion 319, (ii) a valve member 32 comprising a valve body 321, a guiding shaft 322, and a supporting shaft 323, and (iii) a sub-valve member 33 comprising a sub-valve body 331 and a connecting portion 332. Additionally, in an outer peripheral portion of the valve seat member 31, a convex portion 310 to be fitted in the concave portion 13 formed on an inner peripheral surface of the opening portion 12 is formed. By this, the valve mechanism 3 is attached to the opening portion 12 in the container main body 1.

Figure 7:
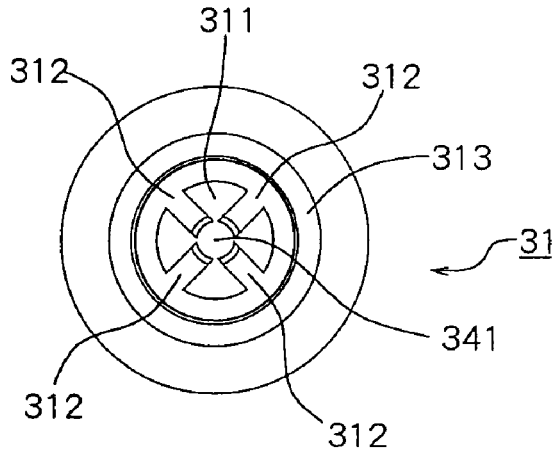
FIGS. 7(*a*) to 7(*d*) are explanatory views showing a valve seat member 31 of the valve mechanism 3.
Figure 7:
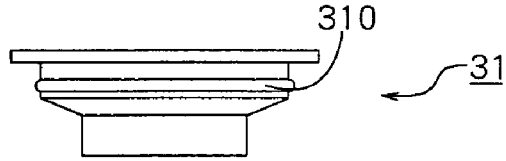
Figure 7:
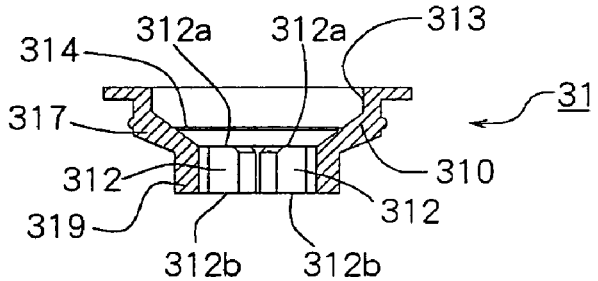
Figure 7:
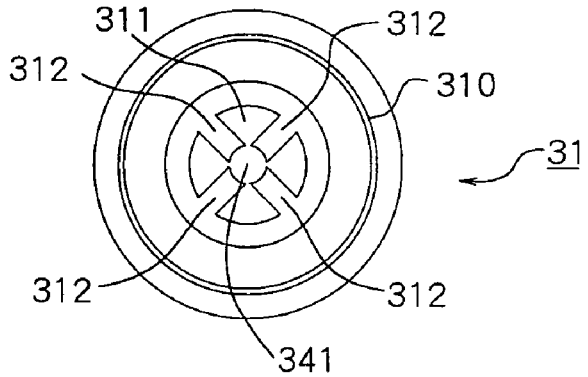

FIGS. 7(*a*)-(*d*) are explanatory views showing the valve seat member 31 in the valve mechanism 3. Of these, FIGS. 7(*a*)-(*d*) are a plan view, lateral view, lateral cross section, and back side view, respectively, showing the valve seat member 31.

The valve seat member 31 comprises a tapered valve seat 317 having an annular convex portion 314, a guiding portion 319 having an opening portion 311 formed at its bottom and four ribs 312 as guiding portions, and a nearly tubular inner wall 313 formed in an upper portion. The four ribs 312 are disposed at even intervals inside the opening portion 311. Additionally, at an upper end portion of each rib 312, a lower upper-end locking portion 312*a* is formed, and at a lower end portion of each rib 312, a lower lower-end locking portion 312*b* is formed. The ribs 312 extend from a circumference toward a center 341 where the guiding shaft slides.

Figure 8:
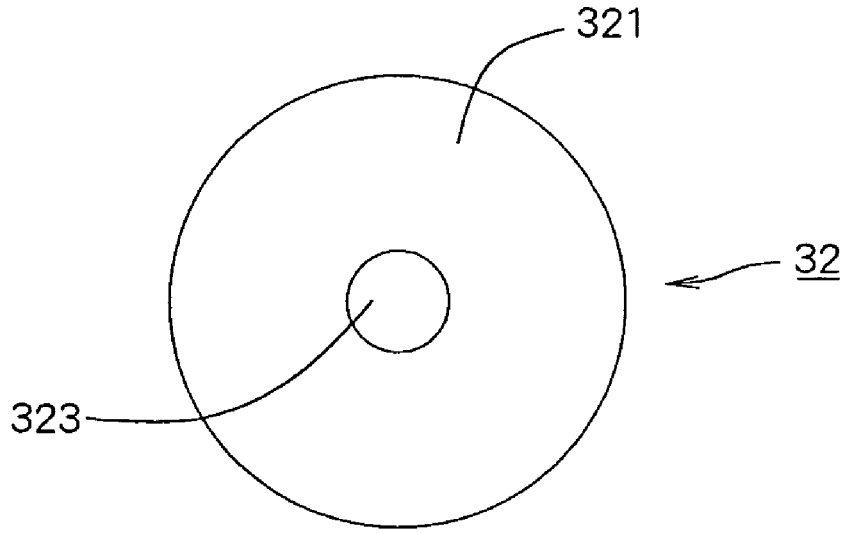
FIGS. 8(*a*) to 8(*c*) are explanatory views showing a valve member 32 of the valve mechanism 3.
Figure 8:
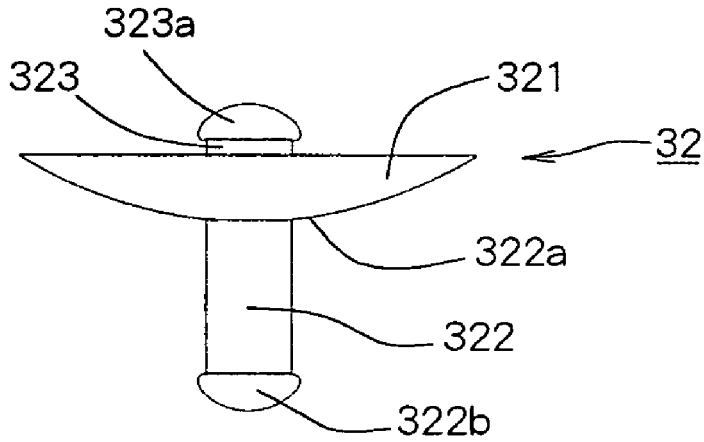
Figure 8:
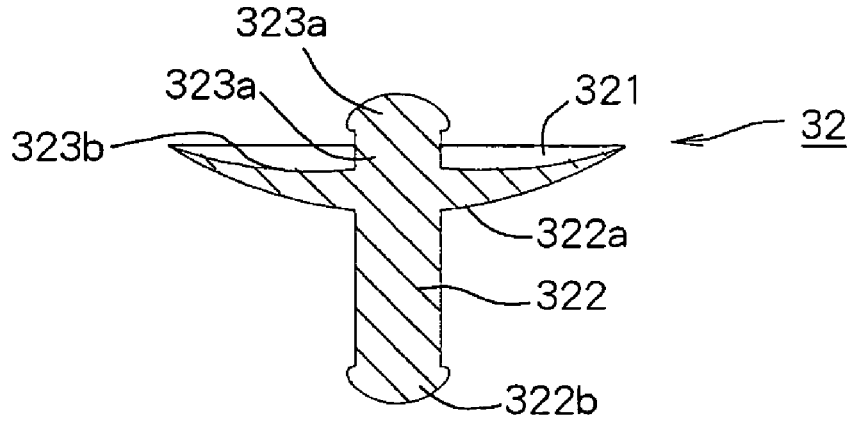

FIGS. 8(*a*)-(*c*) are explanatory views showing the valve member 32 in the valve mechanism 3. Of these, FIGS. 8(*a*)-(*c*) are a plan view, lateral view, and lateral cross section, respectively, showing the valve member 32.

The valve member 32 comprises the valve body 321, the guiding shaft 322 and the supporting shaft 323.

The valve body 321 has a shape corresponding to that of the opening portion 311 and is constructed to be able to travel between a closed position in which it closes the opening portion 311 and an open position in which it opens the opening portion 311.

The guiding shaft 322 is installed upright from the valve body 321. This guiding shaft 322 is connected to the ribs 312 so as to be able to slide between the ribs 312 of the valve seat member 31. Consequently, it becomes possible to prevent the valve body 321 from inadequately tilting due to traveling. Additionally, in this guiding shaft 322, a lower upper-end engaging portion 322*a* to be engaged with the lower upper-end locking portion 312*a* is formed; a lower lower-end engaging portion 322*b* to be engaged with a lower lower-end locking portion 312*b* is formed. Consequently, the valve seat member 31 and the valve member 32 are connected to each other mutually slidably between a lower upper-end engaging position in which the lower upper-end locking portion 312*b* and the lower upper-end engaging portion 322*a* are engaged, and a lower lower-end engaging position in which the lower lower-end locking portion 312*b* and the lower lower-end engaging portion 322*b* are engaged. By this, it becomes possible to control sliding of the valve seat member 31 and the valve member 32.

The supporting shaft 323 is installed upright from the valve body 321 in a direction opposite to the guiding shaft 322. Additionally, at an upper end portion of the supporting shaft 323, an upper upper-end locking portion 323*a* is formed, and at its lower end, an upper lower-end locking portion 323*b* is formed.

Figure 9:
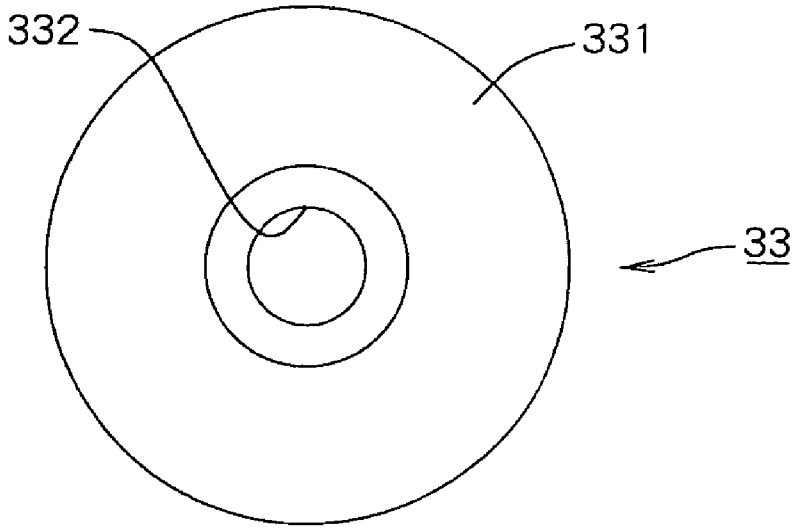
FIGS. 9(*a*) to 9(*c*) are explanatory views showing a sub-valve member 33 of the valve mechanism 3.
Figure 9:
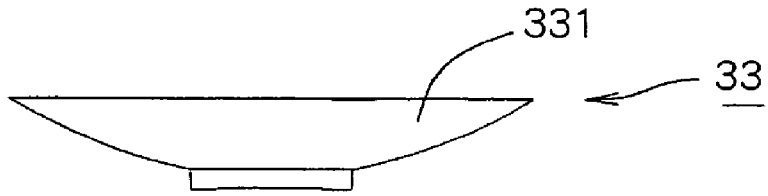
Figure 9:
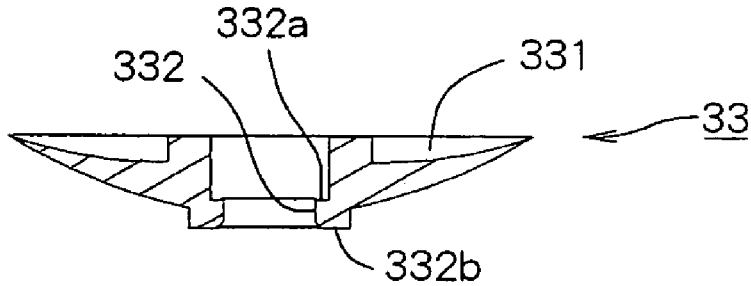

FIGS. 9(*a*)-(*d*) are explanatory views showing the sub-valve member 33 in the valve mechanism 3. Of these, FIGS. 9(*a*)-(*c*) are a plan view, lateral view, and lateral cross section, respectively, showing the sub-valve member 33.

The sub-valve member 33 comprises a sub-valve body 331 and a connecting portion 332.

The sub-valve body 331 is adapted to be able to travel between a contact position in which it comes in contact with the inner wall 313 in the valve seat member 31 and a detached position in which it separates from the inner wall.

The connecting portion 332 is connected to the supporting shaft 323 in the valve member 32. Additionally, in this connecting portion 332, an upper upper-end engaging portion 332*a* engaging with the upper upper-end locking portion 323*a* is formed; and an upper lower-end engaging portion 332*b* engaging with the upper lower-end locking portion 323*b*. Consequently, the valve member 32 and the sub-valve member 33 are connected to each other mutually slidably between an upper upper-end engaging position in which the upper upper-end locking portion 323*a* and the upper upper-end engaging portion 332*a* are engaged, and an upper lower-end engaging position in which the upper upper-end locking portion 332*a* and the upper lower-end engaging portion 332*b* are engaged. By this, it becomes possible to control sliding of the valve member 32 and the sub-valve member 33.

The valve mechanism 3 like this is constructed so that the valve body 321 travels to the open position and the sub-valve body 331 travels to the detached position with the valve body 321 and the sub-valve body 331 ascending together when a pressure of the interior of the fluid-storing portion 11 rises above a pressure of the exterior by pressing the fluid-storing portion 11; the valve body 321 travels to the closed position after the valve body 321 and the sub-valve body 331 descend together and the sub-valve body travels to the contact position when a pressure of the interior of the fluid-storing portion 11 drops below a pressure of the exterior with a pressure applied to the fluid-storing portion 11 removed.

An outflow operation of a fluid-storing container to which this valve mechanism 3 applies is explained using FIGS. 2 to 6 again.

As shown in FIG. 2, when the fluid-storing portion 11 is left without being pressed, the valve body 321 in the valve member 32 is disposed in the closed position in which it closes the opening portion 311, and the sub-valve body 331 in the sub-valve member 33 is disposed in the contact position in which it comes in contact with the inner wall 313. Additionally, the valve seat member 31 and the valve member 32 are disposed in the lower upper-end engaging position, and the valve member 32 and the sub-valve member 33 are disposed in the upper lower-end engaging position.

When a pressure of the interior of the fluid-storing portion 11 rises above a pressure of the exterior by pressing the fluid-storing portion 11, the valve member 32 ascends under pressure from the interior of the fluid-storing portion 11 as shown in FIG. 3. With this valve member 32 ascending, the valve member 32 and the sub-valve member 33 are disposed in the upper lower-end engaging position in which the upper lower-end locking portion 323*b* and the upper lower-end engaging portion 332*b* are engaged; and then, the upper lower-end engaging portion 332*b* is under upward pressure from the upper lower-end locking portion 323*b*, and the sub-valve member 33 ascends. With this ascending of the valve member 32 and the sub-valve member 33, the valve body 321 travels to the open position, the sub-valve body travels to the detached position, and a fluid stored inside the fluid-storing portion 11 flows out from the opening portion 12. Additionally, the valve seat member 31 and the valve member 32 are disposed in the lower lower-end engaging position in which the lower lower-end engaging portion 312*b* and the lower lower-end locking portion 322*b* are engaged. Consequently, ascending of the valve member 32 is controlled, and connection of the valve seat member 31 and the valve member 32 will never come off.

In this state, when a pressure applied to the fluid-storing portion 11 is removed, a pressure of the interior of the fluid-storing portion 11 drops below a pressure of the exterior by elastic resilience of the fluid-storing portion 11. When a pressure of the interior of the fluid-storing portion 11 drops below a pressure of the exterior, the valve member 32 descends under suction force from the interior of the fluid-storing portion 11 as shown in FIG. 4. With this descending of the valve member 32, the valve member 32 and the sub-valve member 33 are disposed in the upper upper-end engaging position in which the upper upper-end locking portion 323*a* and the upper upper-end engaging portion 332*a* are engaged; and the upper upper-end engaging portion 332*a* is under downward pressure from the upper upper-end locking portion 323*a*, and the sub-valve member 33 descends. At this time, by suction force from the interior of the fluid-storing portion 11, a fluid remaining in the vicinity of the opening portion 12 is sucked down into the fluid-storing portion 11 after passing through the sub-valve body 33. Consequently, it is possible to prevent a fluid having flowed out from the opening portion 12 from remaining in the vicinity of the opening portion 12. By this, it is possible to prevent a problem of fluid quality change, which is caused by a fluid remaining in the vicinity of the opening portion 12 being exposed to the outside air.

In order to promote fluid flow, when the valve member 32 is placed at the lower lower-end engaging position, a periphery of the sub-valve body 331 may preferably be above the an upper end of the inner wall 313. Further, preferably, when the valve member 32 is placed at the lower lower-end engaging position, a periphery of the valve body 321 may be below the upper end of the inner wall 313.

In the foregoing state, as shown in FIG. 5(*a*), the sub-valve body 331 is disposed in the contact position. At this time, the valve member 32 and the sub-valve member 33 are still in the upper upper-end engaging position and the valve member 32 is not yet placed in a closed position. The lower upper-end engaging portion 322*a* (see FIGS. 8(*b*) and 8(*c*)) is apart from the lower upper-end locking portion 312*a* (see FIG. 7(*c*)) by a distance V2 (FIG. 5(*b*). As the descending movement of the valve member 32 progress further, the following different phenomena may occur:

1) While the valve member 32 moves V2, the sub-valve member 33 also moves V2. In this case, the upper upper-end engaging position remains the same, i.e., the sub-valve member 33 does not move relative to the valve member 32. When a distance that the sub-valve member 33 moves in contact with the inner wall 313 is referred to as W, the equation W=V2 is satisfied.

2) However, the sub-valve member 33 is slidably coupled with the valve member 32, and thus, the suction force can be exerted on the fluid remaining between the sub-valve member 33 and the vale body member 32 while the valve member 32 and the sub-valve member 33 descend. As a result, the sub-valve member 33 gets close to the valve member 33 when the descending movement is in progress. Thus, in this case, the inequality V2<W is satisfied.

3) Further, even after the valve member 32 is placed or is about to be placed in the closed position, while a seal between the valve body 321 and the valve seat 317 is not complete, the fluid between the sub-valve member 33 and the vale body member 32 is drawn to the fluid-storing portion through an incomplete seat between the valve body 321 and the valve seat 317, thereby causing the sub-valve member 33 to be in contact with the valve-body member 32, i.e., in the upper lower-end engaging position (see the broken lines in FIG. 5(*b*) or FIG. 6). In this case, if a distance that the sub-valve member 33 slides against the valve member 32 is referred to as V1, the equation V1+V2=W is satisfied (also V2<W).

4) If a seal between the valve body 321 and the valve seat 317 becomes complete before the sub-valve member 33 reaches the upper lower-end engaging position, the inequality V2<W is satisfied.

For preventing a back flow or achieving a complete seal, preferably, the inequality V2<W is satisfied. In an embodiment, the sub-valve member 33 may be fixedly integrated with the valve member 32, i.e., V1=0. In this case V2=W. In order to accomplish the inequality V2<W, a diameter of the valve body 321 may be smaller than that of the sub-valve body 331. Further, the valve body 32 may be more resilient than the sub-valve body 33. In order to improve a seal, an annular convex portion 314 may be preferably provided. In a preferred embodiment, the valve body 321 is ensured to travel to the closed position after the sub-valve body 331 travels to the contact position. By this, it becomes possible to make a fluid amount remaining in the vicinity of the opening portion 12 as small as possible.

5) If the sub-valve body 331 is less flexible and stays at the top edge of the inner wall 313, the valve member 32 may move upward as the fluid between the sub-valve body 313 and the valve body 321 is drawn toward the fluid-storing portion. That is, as shown in FIG. 5(*c*), by suction force from the interior of the fluid-storing portion 11, a fluid sucked between the sub-valve body 331 and the valve body 321 is sucked down into the fluid-storing portion 11 after further passing through the valve body 321; and when a fluid amount sucked between the sub-valve body 331 and the valve body 321 is decreased, the valve member 32 and the sub-valve member 33 are again disposed in the upper lower-end engaging position in which the upper lower-end locking portion 323*b* and the upper lower-end engaging portion 332*b* are engaged.

When a pressure of the interior of the fluid-storing portion 11 becomes equal to that of the exterior, the valve body 321 is disposed in the closed position as shown in FIG. 6. Additionally, the valve seat member 31 and the valve member 32 are disposed in a lower upper-end position in which the lower upper-end engaging portion 312*a* and the lower upper-end locking portion 322*a* are engaged. Consequently, descending of the valve member 32 is controlled.

Additionally, in an embodiment, a contact-travel distance that the sub-valve body 331 travels while being in contact with the inner wall 313 in the valve seat member 31 can be adapted to be shorter than a sliding distance between the valve member 32 and the sub-valve member 33.

In the above, when the valve member 32 is in the closed position, the lower upper-end engaging portion 322*a* engages with the lower upper-end locking portion 312*a* at the lower upper-end engaging position. However, the lower upper-end engaging position need not occur (i.e., the lower upper-end engaging portion 322*a* need not be in contact with the lower upper-end locking portion 312*a*) as long as the valve body 321 is in contact with the valve seat 317 (and the annular convex portion 314) and seals the opening 318.

An alternative embodiment of the present invention is described based on the drawings attached. Additionally, for the portions identical to those of the first embodiment described above, detailed descriptions are omitted by marking them with the same symbols.

Figure 10:
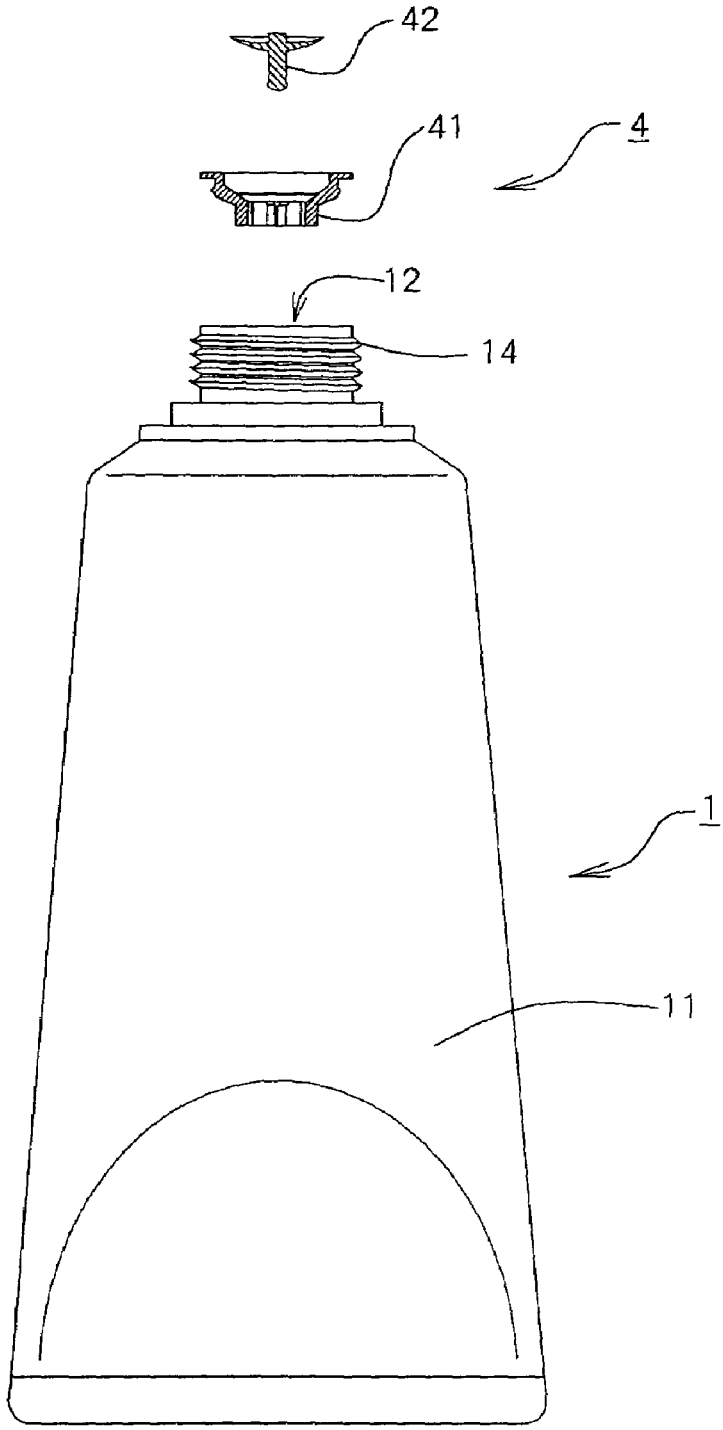
FIG. 10 is a longitudinal partially sectional view which shows a fluid-storing container according to a second embodiment of the present invention by taking it apart to pieces.

FIG. 10 is a partial longitudinal sectional view which shows a fluid-storing container according to the second embodiment of the present invention by taking it apart to pieces.

The fluid-storing container according to the second embodiment of the present invention uses a valve mechanism 4 in place of the valve mechanism 3 in the fluid-storing container according to the first embodiment of the present invention.

FIGS. 11 to 14 are longitudinal sectional views showing the valve mechanism 4 in the fluid-storing container according to the second embodiment of the present invention.

Figure 11:
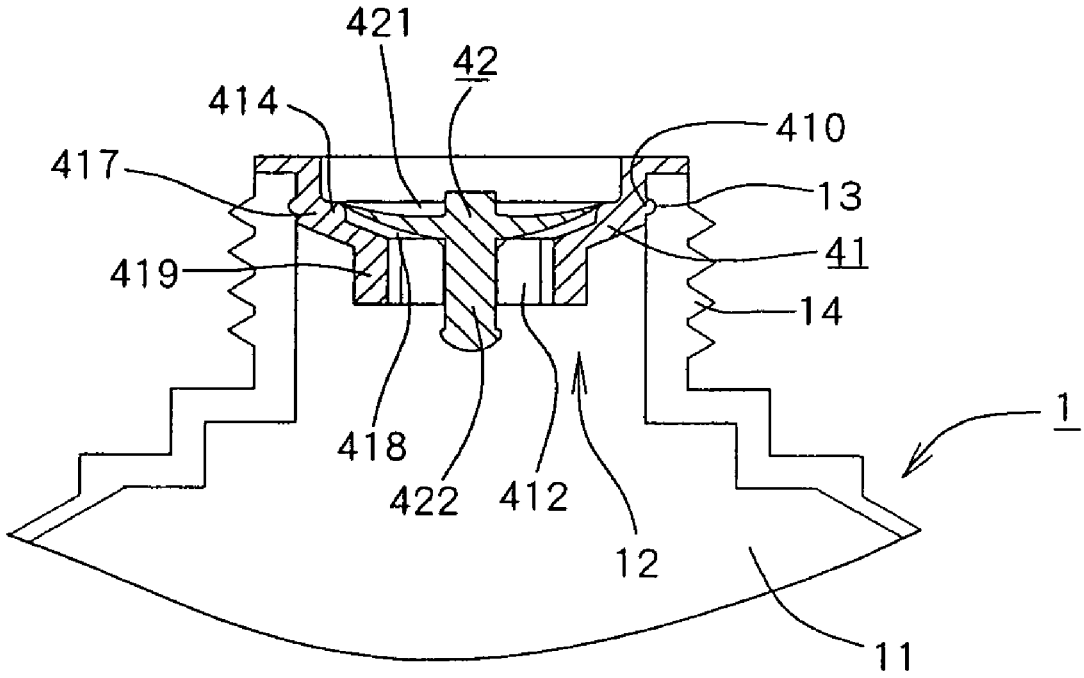
FIG. 11 is a longitudinal sectional view showing a related portion of a valve mechanism 4 according to the second embodiment of the present invention.
Figure 12:
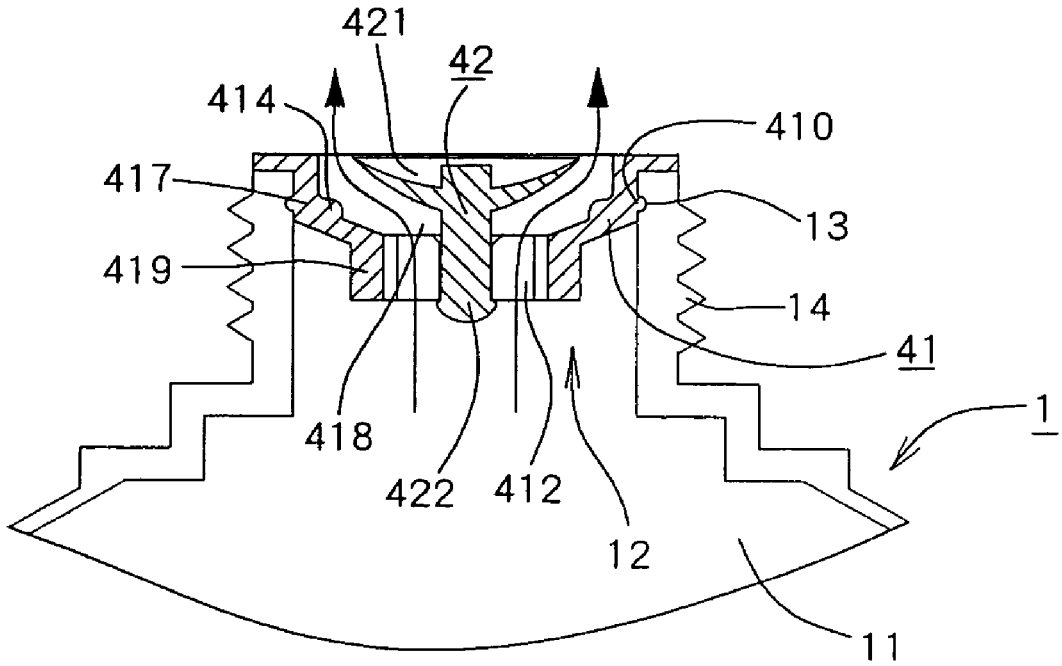
FIG. 12 is a longitudinal sectional view showing a related portion of the valve mechanism 4 when the inside pressure increases according to the second embodiment of the present invention.
Figure 13:
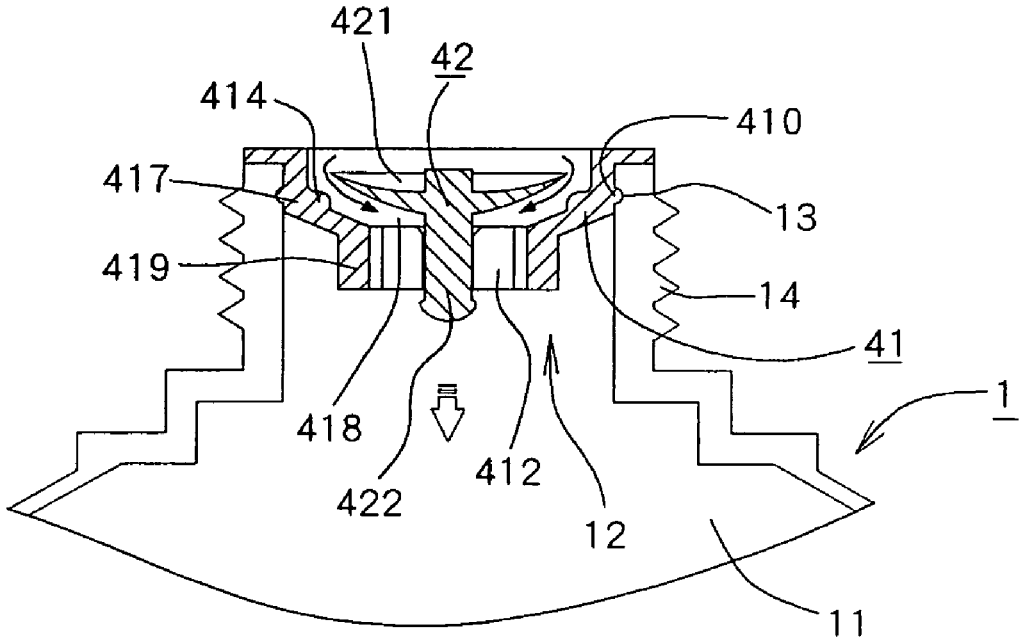
FIG. 13 is a longitudinal sectional view showing a related portion of the valve mechanism 4 when the inside pressure decrease according to the second embodiment of the present invention.
Figure 14:
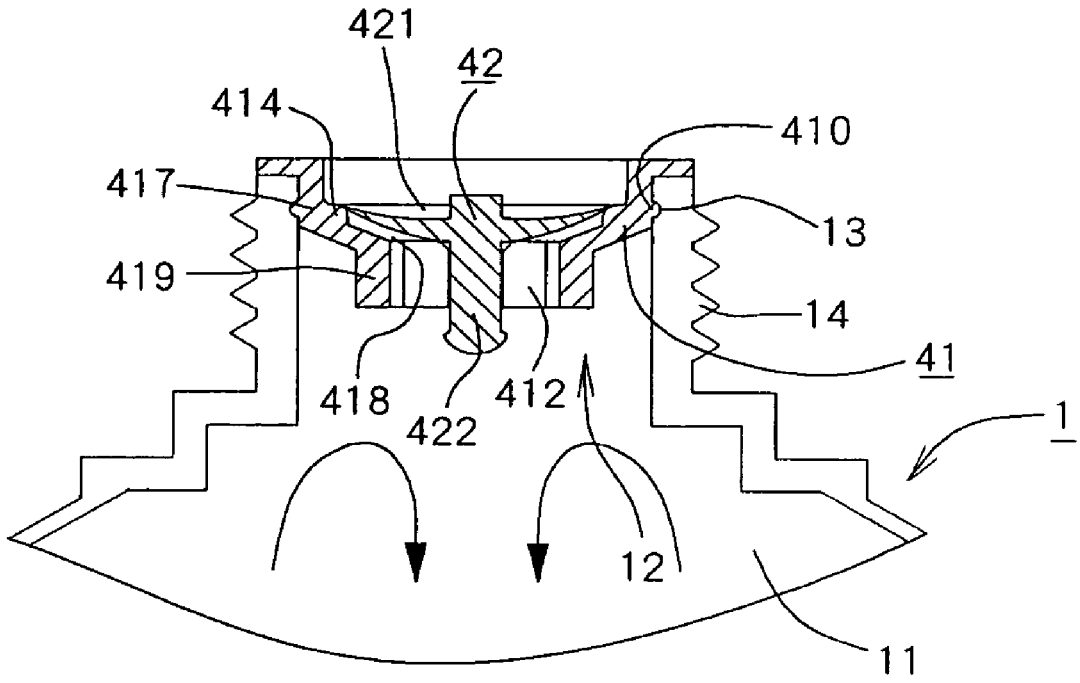
FIG. 14 is a longitudinal sectional view showing a related portion of the valve mechanism 4 when the valve mechanism is completely closed according to the second embodiment of the present invention.

Additionally, of these figures, FIG. 11 shows a state in which the fluid-storing portion 11 is left without being pressed; FIG. 12 shows a state in which the valve mechanism 4 opens the opening portion 12 with the fluid-storing portion 11 being pressed; FIG. 13 shows a state in which a fluid remaining in the vicinity of the opening portion 12 is being sucked down into the fluid-storing portion 11 with a pressure applied to the fluid-storing portion 11 being removed; FIG. 14 shows a state in which the valve mechanism 4 completely closes the opening portion 12.

As shown in these FIGS. 11 to 14, the valve mechanism 4 comprises (i) a valve seat member 41 comprising a valve seat 417 with an opening 418 and a guiding portion 419, (ii) a valve member 42 comprising a valve body 421 and a guiding shaft 422. The valve seat 417 is provided with a convex surface 414. Additionally, in an outer peripheral portion of the valve seat member 41, a convex portion 410 to be fitted in the concave portion 13 formed on an inner peripheral surface of the opening portion 12 is formed. By this, the valve mechanism 4 is attached to the opening portion 12 in the container main body 1.

Figure 15:
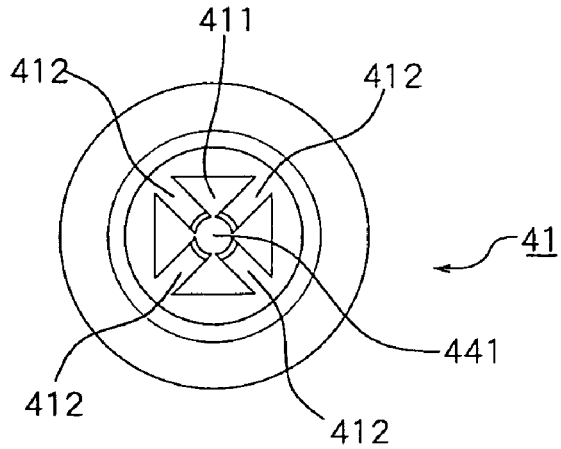
FIGS. 15(*a*) to 15(*d*) are explanatory views showing a valve seat member 41 of the valve mechanism 4.
Figure 15:
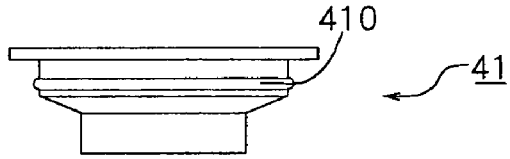
Figure 15:
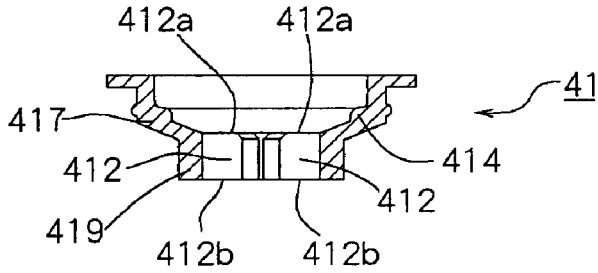
Figure 15:
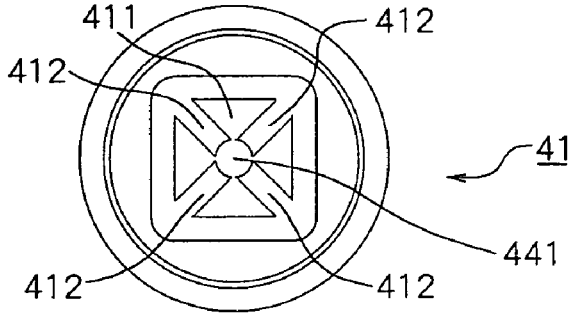

FIGS. 15(*a*)-(*d*) are explanatory views showing the valve seat member 41 in the valve mechanism 4. Of these, FIGS. 15(*a*)-(*d*) are a plan view, lateral view, lateral cross section, and back side view, respectively, showing the valve seat member 41.

The valve seat member 41 comprises (i) the guiding portion 419 which comprises an opening portion 411 formed at its bottom and four ribs 412 as guiding portions, and the valve seat 417 provided with the nearly annular convex surface 414 formed in an upper portion of the ribs 412. The ribs extend from a circumference toward a center 441 where the guiding shaft slides. The four ribs 312 are disposed at even intervals inside the opening portion 411. The opening portion 411 is formed in a quadrangular shape. Consequently, it becomes possible to improve flowing of a fluid passing through the opening portion 411. Additionally, at an upper end portion of each rib 412, a lower upper-end locking portion 412*a* is formed, and at a lower end portion of each rib 412, a lower lower-end locking portion 412*b* is formed.

Figure 16A:
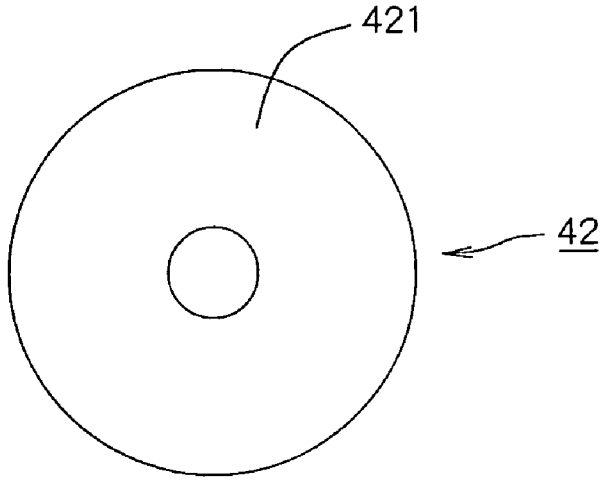
FIGS. 16(*a*) to 16(*c*) are explanatory views showing a valve member 42 of the valve mechanism 4.
Figure 16B:
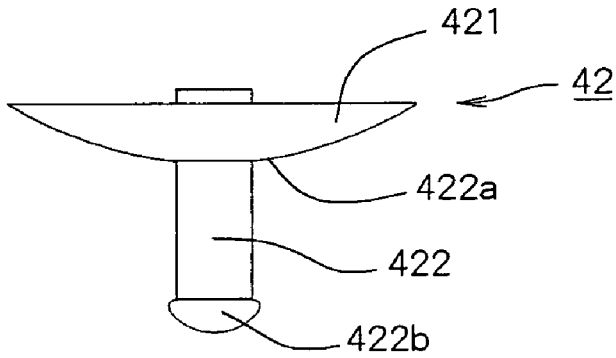
Figure 16C:
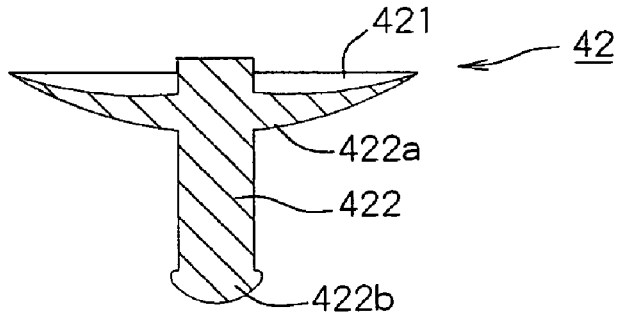

FIG. 16(*a*)-(*c*) are explanatory views showing the valve member 42 in the valve mechanism 4. Of these, FIGS. 16(*a*)-(*c*) are a plan view, lateral view, and lateral cross section, respectively, showing the valve member 42.

The valve member 42 comprises a valve body 421 and a guiding shaft 422.

The valve body 421 has a shape which corresponds to that of the opening portion 411 and closely comes in contact with the convex surface 414. The valve body 421 is constructed to be able to travel between a closed position in which it closes the opening portion 411 and an open position in which it opens the opening portion 411. Additionally, the convex surface 414 is formed directly above the ribs 412. Consequently, it is possible to make a fluid amount remaining in the vicinity of the opening portion 12 as small as possible.

The guiding shaft 422 is installed upright from the valve body 421. This guiding shaft 422 is connected to the ribs 412 so as to be able to slide between the ribs 412 of the valve seat member 41. Consequently, it becomes possible to prevent the valve body 421 from inadequately tilting due to traveling. Additionally, in this guiding shaft 422, a lower upper-end engaging portion 422*a* to be engaged with the lower upper-end locking portion 412*a* is formed; and a lower lower-end engaging portion 422*b* to be engaged with a lower lower-end locking portion 412*b* is formed. Consequently, the valve seat member 41 and the valve member 42 are connected to each other mutually slidably between a lower upper-end engaging position in which the lower upper-end locking portion 412*b* and the lower upper-end engaging portion 422*a* are engaged, and the lower lower-end engaging position in which the lower lower-end locking portion 412*b* and the lower lower-end engaging portion 422*b* are engaged. By this, it becomes possible to control sliding of the valve seat member 41 and the valve member 42.

The valve mechanism 4 like this is constructed so that the valve body 421 travels to the open position by ascending when a pressure of the interior of the fluid-storing portion 11 rises above a pressure of the exterior by pressing the fluid-storing portion 11; the valve body 421 travels to the closed position by descending when a pressure of the interior of the fluid-storing portion 11 drops below a pressure of the exterior with a pressure applied to the fluid-storing portion 11 removed.

An outflow operation of a fluid-storing container to which this valve mechanism 4 applies is explained using FIGS. 11 to 14 again.

As shown in FIG. 11, when the fluid-storing portion 11 is left without being pressed, the valve body 421 in the valve member 42 is disposed in a closed position in which it closes the opening portion 411. Additionally, the valve seat member 41 and the valve member 42 are disposed in a lower upper-end engaging position.

When a pressure of the interior of the fluid-storing portion 11 rises above a pressure of the exterior by pressing the fluid-storing portion 11, the valve member 42 ascends under pressure from the interior of the fluid-storing portion 11 as shown in FIG. 12. With this valve member 42 ascending, the valve body 421 travels to the open position, and a fluid stored inside the fluid-storing portion 11 flows out. Additionally, the valve seat member 41 and the valve member 42 are disposed in the lower lower-end engaging position in which the lower lower-end engaging portion 412*b* and the lower lower-end locking portion 422*b* are engaged. Consequently, ascending of the valve member 42 is controlled, and connection of the valve seat member 41 and the valve member 42 will never come off.

In this state, when a pressure applied to the fluid-storing portion 11 is removed, a pressure of the interior of the fluid-storing portion 11 drops below a pressure of the exterior by elastic resilience of the fluid-storing portion 11. Like this, when a pressure of the interior of the fluid-storing portion 11 drops below a pressure of the exterior, the valve member 42 descends under suction force from the interior of the fluid-storing portion 11 as shown in FIG. 13. At this time, by suction force from the interior of the fluid-storing portion 11, a fluid remaining in the vicinity of the opening portion 12 is sucked down into the fluid-storing portion 11 after passing through the valve body 421. Consequently, it is possible to prevent a fluid having flowed out from the opening portion 12 from remaining in the vicinity of the opening portion 12. By this, it is possible to prevent occurrence of a problem of fluid quality change, which is caused by a fluid remaining in the vicinity of the opening portion 12 being exposed to the outside air.

When a pressure of the interior of the fluid-storing portion 11 becomes equal to that of the exterior, the valve body 421 is disposed in the closed position as shown in FIG. 14. Additionally, the valve seat member 41 and the valve member 42 are disposed in the lower upper-end position in which the lower upper-end engaging portion 412*a* and the lower upper-end locking portion 422*a* are engaged. Consequently, descending of the valve member 32 is controlled.

In the above, when the valve member 42 is in the closed position, the lower upper-end engaging portion 422*a* engages with the lower upper-end locking portion 412*a* at the lower upper-end engaging position. However, the lower upper-end engaging position need not occur (i.e., the lower upper-end engaging portion 422*a* need not be in contact with the lower upper-end locking portion 412*a*) as long as the valve body 421 is in contact with the valve seat 417 (and the convex surface 414) and seals the opening 418.

Additionally, it is preferable that the valve mechanism 3 in the first embodiment of the present invention and the valve mechanism 4 in the second embodiment are composed of a material using, for example, a resin such as polyethylene and polypropylene, synthetic rubber such as silicon rubber, or a mixture of the foregoing.

Additionally, the valve seat member 31 in the first embodiment of the present invention and the valve seat member 41 in the second embodiment comprise four ribs, but may comprise plural ribs other than four.

Additionally, in the second embodiment of the present invention, the opening portion 411 is formed in a quadrangular shape, but it may be formed in a shape other than the quadrangular shape as long as it is formed in an opening shape that a fluid can pass through.

Additionally, the fluid-storing containers according to the first and second embodiments of the present invention have a configuration that a fluid discharge amount can be changed according to a pressure applied to the fluid-storing portion 11. With this configuration, for example, it is possible to discharge a fluid stored inside the fluid-storing portion 11 drop by drop by applying a small pressure to the fluid-storing portion 11, or to discharge a large amount of fluid stored inside the fluid-storing portion 11 by applying a large pressure to the fluid-storing portion 11.

Figure 17:
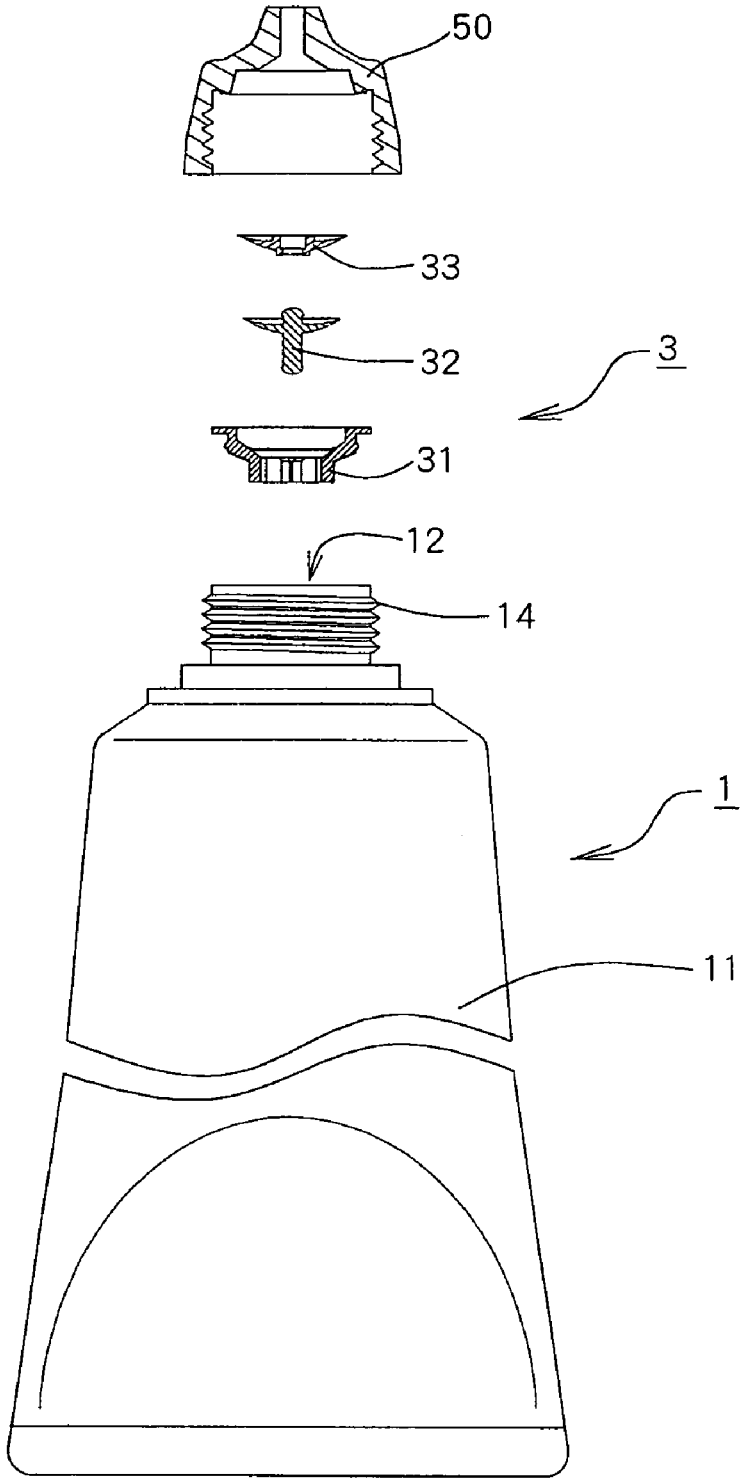
FIG. 17 is a longitudinal partially sectional view which shows a fluid-storing container comprising a nozzle 50 by taking it apart to pieces.
Figure 18:
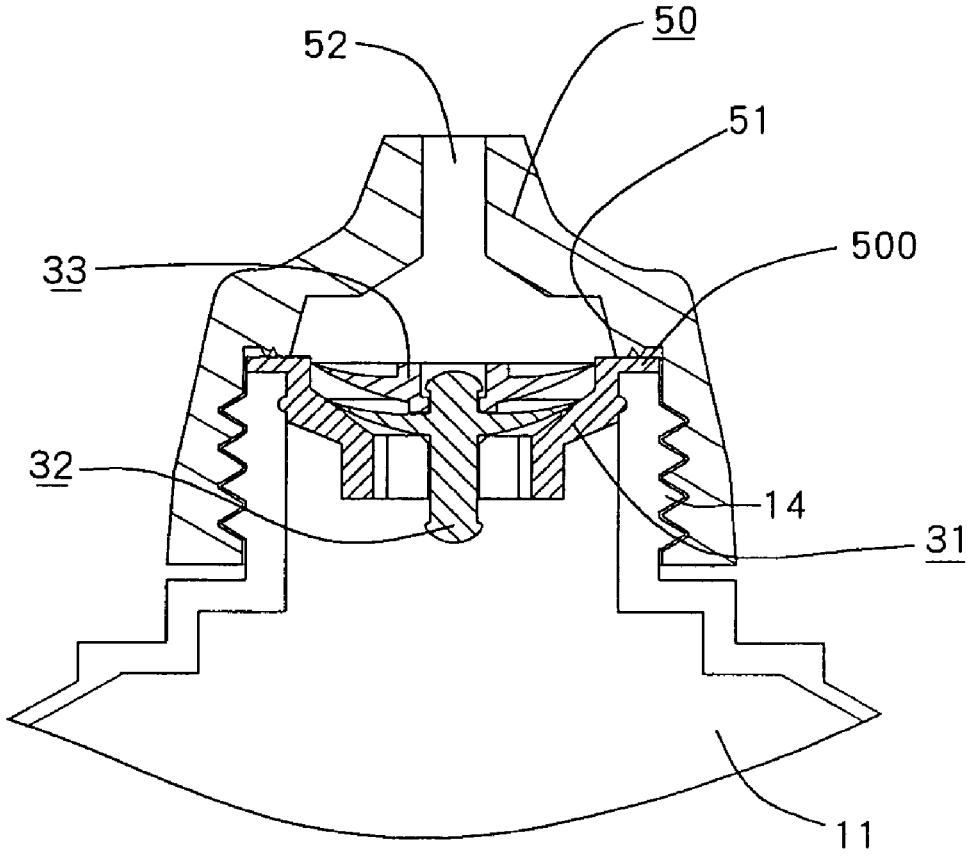
FIG. 18 is a cross-sectional view showing the fluid-storing container with the nozzle.
Figure 19:
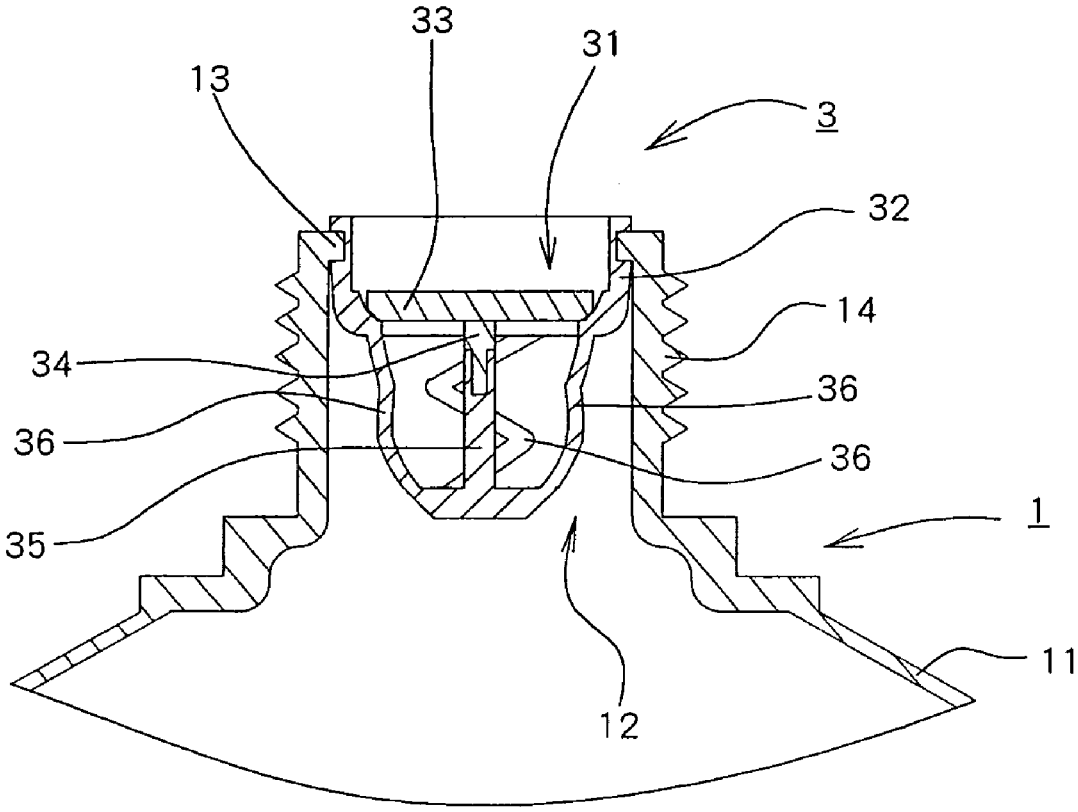
Fig.19 Prior Art
FIG. 19 is a longitudinal sectional view showing a conventional fluid-storing container.

Additionally, in order to discharge a fluid drop by drop, a nozzle 50 may be provided in an end portion on the fluid discharge side in the fluid discharge container as shown in FIG. 17. By providing this nozzle 50, it becomes possible to furthermore control a fluid discharge amount. FIG. 18 shows the valve mechanism with the nozzle 50. The valve seat member may have an annular flange 500 which is sandwiched between the nozzle 50 and the mouth portion 12. The nozzle 50 is preferably configured to minimize the fluid remaining inside the nozzle 50 by, for example, using a tapered inner wall 51 connected to the valve mechanism and/or using a relatively narrow and/or short outlet 52. Preferably, when the valve mechanism is at closed position, substantially no fluid remains inside the nozzle 50.

In an embodiment, the upward movement of the sub-valve member 33 can be restricted using the nozzle 50, without the upper upper-edge locking portion 323*a* or the upper upper-edge engaging portion 332*a*. In this case, a portion of the nozzle with which the sub-valve body is in contact may has grooves or slits so that when the sub-valve body is placed at an upper position, fluid passage may not be blocked.

The present invention includes the above mentioned embodiments individually or in any combination and can achieve one or more of the following effects:

In an embodiment, the valve mechanism is installed upright and comprises the valve member having a guiding shaft slidably connected to the guiding portion in the valve seat member, whereby it becomes possible to prevent the valve body from inadequately tilting while it has a simple configuration.

In an embodiment, the valve seat member and the valve member are connected to each other mutually slidably between a lower upper-end engaging position in which the lower upper-end locking portion and the lower upper-end engaging portion are engaged, and a lower lower-end engaging position in which the lower lower-end locking portion and the lower lower-end engaging portion are engaged, whereby it becomes possible to control sliding of the valve seat member and the valve member.

In an embodiment, the valve body travels to the open position and the sub-valve body travels to the detached position with the valve body and the sub-valve body ascending together when a pressure of the interior of the fluid-storing portion rises above a pressure of the exterior, and the valve body travels to the closed position with the valve body and the sub-valve body descending together and after the sub-valve body travels to the contact position in which it comes in contact when a pressure of the interior of the fluid-storing portion drops below a pressure of the exterior, whereby it becomes possible to make a fluid amount remaining in the vicinity of the opening portion as small as possible.

In an embodiment, the valve member and the sub-valve member are connected to each other mutually slidably between an upper upper-end engaging position in which the upper upper-end locking portion and the upper upper-end engaging portion are engaged, and an upper lower-end engaging position in which the upper lower-end locking portion and the upper lower-end engaging portion are engaged, whereby it becomes possible to make a fluid amount remaining in the vicinity of the opening portion further as small as possible.

In an embodiment, a contact-travel distance which the sub-valve body travels while being in contact with an inner wall in the valve seat member is adjusted relative to a sliding distance between the valve member and the sub-valve member, whereby it becomes possible to ensure the valve body to travel to the closed position after the sub-valve body has traveled to the contact position. Consequently, it becomes possible to make a fluid amount remaining in the vicinity of the opening portion as small as possible.

In an embodiment, the valve mechanism may comprise more than one sub-valve; i.e., three or more valve body can be provided in the valve mechanism.

The present application claims priority to Japanese Patent Application No. 2004-223681, filed Jul. 30, 2004, the disclosure of which is incorporated herein by reference in its entirety.

It will be understood by those of skill in the art that numerous and various modifications can be made without departing from the spirit of the present invention. Therefore, it should be clearly understood that the forms of the present invention are illustrative only and are not intended to limit the scope of the present invention.

What is claimed is:

1. A fluid-storing container comprising:

a container main body comprising a shape-restorable fluid-storing portion for storing a fluid therein and a mouth portion formed at an end of the fluid-storing portion for discharging the fluid; and a valve mechanism attached to the mouth portion and comprising:

(a) a valve seat member comprising: (i) a valve seat with an opening through which the fluid is to pass, and (ii) a guiding portion disposed under the valve seat coaxially with the opening, and (b) a non-biased valve member comprising: (i) a valve body having a shape corresponding to that of the valve seat for opening and closing the opening of the valve seat depending on a pressure inside the fluid-storing portion, and (ii) a guiding shaft integrated under the valve body coaxially with the valve body and slidably coupled with the guiding portion of the valve seat member, wherein the valve mechanism further comprises a sub-valve body disposed above and coupled with the valve body coaxially with the valve body, wherein the valve seat member further comprises an inner wall extending from the valve seat upward, with which a periphery of the sub-valve body is in non-contact and contact for respectively opening and closing a clearance therebetween depending on a pressure inside the fluid-storing portion.

2. The fluid-storing container according to claim 1, wherein the valve member further comprises a supporting shaft integrated above the valve body coaxially with the valve body, said sub-valve body being provided with a connecting portion which is slidably coupled with the supporting shaft.

3. The fluid-storing container according to claim 2, wherein the supporting shaft has an upper end engaging portion which engages with a lower end of the connecting portion to restrict upward movement of the connecting portion.

4. The fluid-storing container according to claim 2, wherein a distance which the sub-valve body slides downward against the inner wall is greater than a distance which the guiding shaft moves downward while the sub-valve body is in contact with the inner wall.

5. The fluid-storing container according to claim 1, wherein the sub-valve body has a diameter which is greater than that of the valve body.

6. A fluid-storing container comprising:

a container main body comprising a shape-restorable fluid-storing portion for storing a fluid therein and a mouth portion formed at an end of the fluid-storing portion for discharging the fluid; and a valve mechanism attached to the mouth portion and comprising:

(a) a valve seat member comprising: (i) a valve seat with an opening through which the fluid is to pass, and (ii) a guiding portion disposed under the valve seat coaxially with the opening, and (b) a non-biased valve member comprising: (i) a valve body having a shape corresponding to that of the valve seat for opening and closing the opening of the valve seat depending on a pressure inside the fluid-storing portion, and (ii) a guiding shaft integrated under the valve body coaxially with the valve body and slidably coupled with the guiding portion of the valve seat member, wherein the guiding portion is comprised of multiple ribs each extending inward from a circumference to a center where the guiding shaft is supported.

7. The fluid-storing container according to claim 6, wherein the guiding shaft has a lower end engaging portion which engages with a lower end of the guiding portion to restrict upward movement of the guiding shaft.

8. The fluid-storing container according to claim 6, wherein the valve seat has an annular convex portion which is in contact with the valve body for closing the opening of the valve seat member.

9. The fluid-storing container according to claim 6, wherein a gap is formed between the ribs, which is communicated with the opening and through which the fluid is to pass.

10. The fluid-storing container according to claim 6, wherein the valve seat is tapered downward.

11. The fluid-storing container according to claim 6, further comprising a nozzle attached to the mouth portion of the container main body.

12. The fluid-storing container according to claim 6, wherein the valve mechanism further comprises a sub-valve body disposed above and coupled with the valve body coaxially with the valve body, wherein the valve seat member further comprises an inner wall extending from the valve seat upward, with which a periphery of the sub-valve body is in non-contact and contact for respectively opening and closing a clearance therebetween depending on a pressure inside the fluid-storing portion.

13. The fluid-storing container according to claim 12, wherein the valve member further comprises a supporting shaft integrated above the valve body coaxially with the valve body, said sub-valve body being provided with a connecting portion which is slidably coupled with the supporting shaft.

14. The fluid-storing container according to claim 12, wherein the sub-valve body has a diameter which is greater than that of the valve body.

15. The fluid-storing container according to claim 13, wherein a distance which the sub-valve body slides downward against the inner wall is greater than a distance which the guiding shaft moves downward while the sub-valve body is in contact with the inner wall.

16. A fluid-storing container composed comprising:

a container main body comprising: (i) a fluid-storing portion having elastic resilience for storing a fluid therein, and (ii) a mouth portion formed at an end of the fluid-storing portion for discharging the fluid; and a valve mechanism attached to the mouth portion, wherein the valve mechanism opens the mouth portion when a pressure inside the fluid-storing portion rises above a pressure of the exterior, and the valve mechanism closes the mouth portion when a pressure inside the fluid-storing portion drops below a pressure of the exterior, said valve mechanism comprising:

(a) a valve seat member comprising: (i) an opening portion formed at its bottom and (ii) a guiding portion; and (b) a valve member comprising: (i) a valve body having a shape corresponding to that of the opening portion, which can travel between a closed position in which the valve body closes the opening portion of the valve seat member and an open position in which the valve body opens the opening portion; and (ii) a guiding shaft installed upright and slidably connected to the guiding portion of the valve seat member, wherein the valve member of the valve mechanism further comprises a supporting shaft disposed upright in a direction opposite to the guiding shaft from the valve body;

a nearly tubular inner wall is formed at a top of the valve seat member of the valve mechanism;

the valve mechanism further comprises a sub-valve member comprising (i) a sub-valve body which can travel between a contact position in which the sub-valve body comes in contact with the inner wall of the valve seat member and a detached position in which the sub-valve body separates from the inner wall, and (ii) a connecting portion connected to the supporting shaft in said valve member;

wherein when a pressure inside fluid-storing portion rises above a pressure of the exterior, with the valve body and the sub-valve body ascending together, the aid valve body travels to the open position, and the aid sub-valve body travels to the detached position, and when a pressure inside fluid-storing portion drops below a pressure of the exterior, with the valve body and the sub-valve body descending together and after the sub-valve body travels to the contact position, the valve body travels to the closed position.

17. The fluid-storing container according to claim 16, wherein a lower upper-end locking portion is formed at an upper end portion of the guiding portion of the valve seat member, and a lower lower-end locking portion is formed at its lower end portion;

in the guiding shaft of the valve member, a lower upper-end engaging portion engaging with the lower upper-end locking portion is formed, and a lower lower-end engaging portion engaging with the lower-end locking portion is formed; and the valve seat member and the valve member are connected to each other mutually slidably between a lower upper-end engaging position in which the lower upper-end locking portion and the lower upper-end engaging portion are engaged, and a lower lower-end engaging position in which the lower lower-end locking portion and the lower lower-end engaging portion are engaged.

18. The fluid-storing container according to claim 16, wherein an upper upper-end locking portion is formed at an upper-end portion of the supporting shaft, and an upper lower-end locking portion is formed at its lower end;

in the connecting portion in the sub-valve member, an upper upper-end engaging portion engaging with the upper upper-end locking portion is formed, and an upper lower-end engaging portion engaging with the upper lower-end locking portion is formed;

the valve member and the sub-valve member are connected to each other mutually slidably between an upper upper-end engaging position in which the upper upper-end locking portion and the upper upper-end engaging portion are engaged, and an upper lower-end engaging position in which the upper lower-end locking portion and the upper lower-end engaging portion are engaged.

19. The fluid-storing container according to claim 18, wherein a contact-travel distance which the sub-valve body travels while being in contact with the inner wall of the valve seat member is longer than a sliding distance between the valve member and the sub-valve member.

* * * * *